US007205990B2

(12) United States Patent
Ishiyama

(10) Patent No.: US 7,205,990 B2
(45) Date of Patent: Apr. 17, 2007

(54) POWER SUPPLY CIRCUIT, VOLTAGE CONVERSION CIRCUIT, SEMICONDUCTOR DEVICE, DISPLAY DEVICE, DISPLAY PANEL, AND ELECTRONIC EQUIPMENT

(75) Inventor: Hisanobu Ishiyama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 380 days.

(21) Appl. No.: 10/950,570

(22) Filed: Sep. 28, 2004

(65) Prior Publication Data

US 2005/0052447 A1 Mar. 10, 2005

Related U.S. Application Data

(62) Division of application No. 10/237,684, filed on Sep. 10, 2002.

(30) Foreign Application Priority Data

Sep. 14, 2001 (JP) ..... 2001-280209
Sep. 14, 2001 (JP) ..... 2001-280210

(51) Int. Cl.
*G09G 5/00* (2006.01)

(52) U.S. Cl. ..... 345/211; 345/212; 345/213; 345/204; 345/205

(58) Field of Classification Search ..... 345/211, 345/212, 213, 204, 205
See application file for complete search history.

(56) References Cited

U.S. PATENT DOCUMENTS 5,663,743 A * 9/1997 Fujii et al. ..... 345/95
5,815,133 A * 9/1998 Tsuboyama et al. ..... 345/95
5,986,649 A * 11/1999 Yamazaki ..... 345/211

FOREIGN PATENT DOCUMENTS

EP 0 750 208 A1 12/1996

(Continued)

*Primary Examiner*—Richard Hjerpe
*Assistant Examiner*—Leonid Shapiro
(74) *Attorney, Agent, or Firm*—Oliff and Berridge, PLC

(57) ABSTRACT

A power supply circuit which generates a power supply for a circuit which drives a source electrode and a gate electrode provided in a display, includes a first booster circuit which outputs a third potential boosted based on a difference between first and second potentials, a potential regulator circuit which outputs a fourth potential being a constant potential generated based on a difference between the first and third potentials, and a second booster circuit which outputs a fifth potential boosted based on a difference between the first and fourth potentials. The first and fourth potentials are supplied to a source electrode driver circuit, and the first and fifth potentials are supplied to a gate electrode driver circuit. A voltage supplied to the gate electrode driver circuit may be generated by using a voltage conversion circuit. The voltage conversion circuit includes a capacitor which capacitively couples a sixth power supply line to which a negative constant potential based on a first potential is supplied and a node to which a polarity inversion timing signal of a common electrode is supplied, a negative power supply generating circuit which generates a negative output potential based on a booster potential which is the difference between a regulating potential and the first potential, and a switching element connected between the negative power supply generating circuit and the sixth power supply line. A timing signal and a switching control signal of the switching element change in synchronization with each other.

6 Claims, 19 Drawing Sheets

FOREIGN PATENT DOCUMENTS

| | | |
|---|---|---|
| JP | A 07-104705 | 4/1995 |
| JP | 08-271856 | 10/1996 |
| JP | 09-044100 | 2/1997 |
| JP | A 2000-235173 | 8/2000 |
| WO | WO 96/21880 | 7/1996 |

* cited by examiner

STORAGE CAPACITANCE METHOD

ADDITIONAL CAPACITANCE METHOD

POWER SUPPLY CIRCUIT, VOLTAGE CONVERSION CIRCUIT, SEMICONDUCTOR DEVICE, DISPLAY DEVICE, DISPLAY PANEL, AND ELECTRONIC EQUIPMENT

This is a Division of Application Ser. No. 10/237,684 filed Sep. 10, 2002, which claims the benefit of JP 2001-280209 and JP 2001-280210, both filed Sep. 14, 2001 in Japan. The entire disclosure of the prior applications is hereby incorporated by reference herein in its entirety.

Japanese Patent Application No. 2001-135369 filed on May 2, 2001, Japanese Patent Application No. 2001-280209 filed on Sep. 14, 2001, and Japanese Patent Application No. 2001-280210 filed on Sep. 14, 2001, are hereby incorporated by reference in their entirety.

BACKGROUND

The present invention relates to a power supply circuit, a voltage conversion circuit, a semiconductor device, a display device, a display panel, and electronic equipment including the power supply circuit and/or the voltage conversion circuit.

A display device and a power supply circuit used to drive the display are incorporated in electronic equipment such as portable telephones, portable information terminals, or game devices. A decrease in power consumption of the display device and the power supply circuit is strongly demanded in order to realize operations for a long period of time by using a battery as a power supply.

The display device includes a display panel body (display) having pixels specified by a plurality of source electrodes and a plurality of gate electrodes which intersect each other, for example. A source driver (source electrode driver circuit) and a gate driver (gate electrode driver circuit) respectively supply a given voltage to source electrodes and gate electrodes, and control the display of the pixels specified by the source electrodes and the gate electrodes in cooperation.

SUMMARY

One aspect of the present invention relates to a power supply circuit which generates a power supply for a circuit which drives a source electrode and a gate electrode provided in a display, comprising:

a first booster circuit which is connected with first and second power supply lines, which respectively supply first and second potentials, and supplies a third potential which is boosted based on a difference between the first and second potentials to a third power supply line;

a potential regulator circuit which is connected with the first and third power supply lines and supplies a fourth potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line, wherein at least the fourth potential is supplied to a source electrode driver circuit which drives the source electrode, and wherein at least the fifth potential is supplied to a gate electrode driver circuit which drives the gate electrode.

Another aspect of the present invention relates to a power supply circuit which generates a power supply for a circuit which drives a source electrode and a gate electrode provided in a display, comprising:

a first booster circuit which is connected with first and second power supply lines, which respectively supply first (VSS) and second (VDD) potentials, and supplies a third potential (VOUT) which is generated based on a difference between the first and second potentials to a third power supply line;

a potential regulator circuit which is connected with the first and third power supply lines and supplies a fourth (VDDHS, VDGP, etc.) potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line, wherein the first and fourth potentials are supplied to a source electrode driver circuit which drives the source electrode, and wherein the first and fifth potentials are supplied to a gate electrode driver circuit which drives the gate electrode.

Still another aspect of the present invention relates to a voltage conversion circuit which generates an output potential that is negative based on a first potential, comprising:

a capacitor which capacitively couples a node to which a timing signal changing between given potentials is supplied and an output power supply line to which the output potential is supplied;

a negative power supply generating circuit which generates a negative potential based on the first potential based on a difference between the first potential and an input potential which is positive based on the first potential; and a switching element which is inserted between a node to which the negative power supply potential is supplied and the output power supply line, and controlled based on a given switching control signal, wherein the timing signal and the switching control signal change in synchronization with each other.

DETAILED DESCRIPTION

Figure 1:
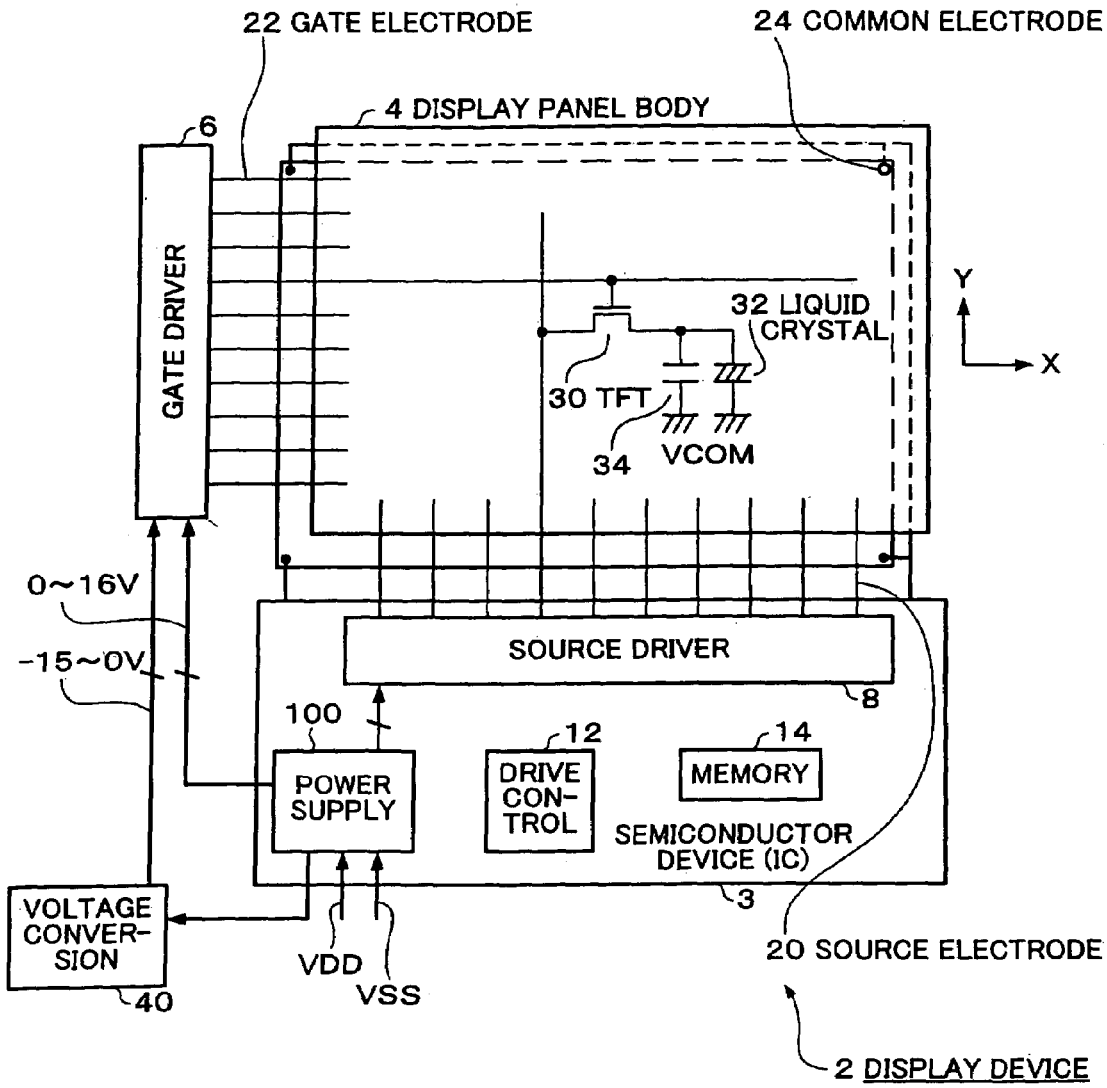
FIG. 1 is a schematic explanatory diagram showing the feature of the configuration of a display device to which a power supply circuit of the present embodiment is applied.

An embodiment of the present invention is described below. Note that the embodiments described hereunder do not in any way limit the scope of the invention defined by the claims laid out herein. Note also that all of the elements of these embodiments should not be taken as essential requirements to the means of the present invention.

A voltage supplied to a gate electrode from a gate driver is higher than a voltage supplied to a source electrode from a source driver. A power supply circuit generates a reference potential and supplies the reference potential to the gate driver and the source driver.

The gate driver or the source driver obtains the potential by using a switching regulator, or by boosting the potential by using a booster circuit and regulating the potential based on the potential supplied from the power supply circuit.

However, a regulator circuit (potential regulator circuit in a broad sense) which regulates the potential consumes a comparatively large amount of power. Moreover, power consumption of the regulator circuit tends to be increased as the absolute voltage to be regulated is increased.

As a measure to reduce the cost by decreasing the number of parts which make up a display device, the power supply circuit which supplies a necessary voltage to the gate driver and the source driver may be incorporated in the source driver.

However, the voltage supplied to the gate electrode from the gate driver is higher than the voltage supplied to the source electrode from the source driver as described above.

Therefore, the power supply circuit which supplies a voltage to the gate driver must be manufactured by using a high voltage process. Because of this, the power supply circuit cannot be incorporated in the source driver by using a high definition process used to manufacture the source driver which has a complicated circuit configuration and for which a high voltage process is unnecessary. Moreover, power consumption of the power supply circuit is increased by generating a high voltage.

According to the following embodiments, a power supply circuit capable of supplying a potential to the gate driver and the source driver while consuming only a small amount of power, a semiconductor device, a display device, a display panel, and electronic equipment including the power supply circuit can be provided. A voltage conversion circuit for supplying a high voltage by using a power supply circuit manufactured by using a high definition, low voltage process while consuming only a small amount of power, a display device and electronic equipment using the voltage conversion circuit can also be provided.

An embodiment of the present invention provides a power supply circuit having the following configuration optimal for generating a liquid crystal drive potential.

An embodiment of the present invention provides a power supply circuit which generates a power supply for a circuit which drives a source electrode and a gate electrode provided in a display, comprising:

a first booster circuit which is connected with first and second power supply lines, which respectively supply first and second potentials, and supplies a third potential which is boosted based on a difference between the first and second potentials to a third power supply line;

a potential regulator circuit which is connected with the first and third power supply lines and supplies a fourth potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line, wherein at least the fourth potential is supplied to a source electrode driver circuit which drives the source electrode, and wherein at least the fifth potential is supplied to a gate electrode driver circuit which drives the gate electrode.

An embodiment of the present invention also provides a power supply circuit which generates a power supply for a circuit which drives a source electrode and a gate electrode provided in a display, comprising:

a first booster circuit which is connected with first and second power supply lines, which respectively supply first (VSS) and second (VDD) potentials, and supplies a third potential (VOUT) which is generated based on a difference between the first and second potentials to a third power supply line;

a potential regulator circuit which is connected with the first and third power supply lines and supplies a fourth potential (VDDHS, VDGP, etc.), which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line, wherein the first and fourth potentials are supplied to a source electrode driver circuit which drives the source electrode, and wherein the first and fifth potentials are supplied to a gate electrode driver circuit which drives the gate electrode.

In the power supply circuit according to any of the embodiments of the present invention, the fourth potential may have a plurality of levels differing from one another.

In the power supply circuit, the second to fifth potentials may be positive based on the first potential.

In the power supply circuit, the source electrode and the gate electrode may be connected with an active driver element provided in a pixel of the display.

In a display panel (display) having an active driver element in the pixel such as a TFT liquid crystal panel (display panel), orientation of the liquid crystal is determined depending upon the potential applied to the source electrode. This considerably affects the quality of the gray scale or color display. Therefore, a highly precise potential must be supplied to the source electrode driver circuit which creates the potential applied to the source electrode. Since it suffices that the potential applied to the gate electrode only controls the gate of the active driver element, it is unnecessary for the potential applied to the gate electrode to be as precise as the potential applied to the source electrode.

Since the power supply circuit, which is configured taking these characteristics into consideration, includes the potential regulator circuit which regulates the boosted third potential (VOUT) into the fourth potential (VDDHS, VDGP, etc.) which is a constant potential, the potential for the source electrode driver circuit can be provided with high precision. Moreover, since the potential is not regulated near the fifth potential (VDDHG) which is a comparatively high potential, a power supply circuit which consumes only a necessary small amount of power in the regulator circuit can be provided.

A display device according to an embodiment of the present invention comprises one of the above power supply circuits, and the source electrode driver circuit with which the first and fourth power supply lines are connected.

With the display device, power consumption of the display device can be decreased by employing the power supply circuit which consumes only a small amount of power.

In the display device, the source electrode driver circuit may include a multi-level potential generating circuit which generates a plurality of potentials based on a difference between the first and fourth potentials.

With the display device, since the first potential and the fourth potential, which is a constant potential, are used for the multi-level potential generating circuit which generates a plurality of potentials, a plurality of highly precise potentials can be generated while achieving a decrease in the power consumption.

A display device according to an embodiment of the present invention comprises:

one of the above power supply circuits;

the source electrode driver circuit with which the first and fourth power supply lines are connected; and the gate electrode driver circuit with which the first and fifth power supply lines and a sixth power supply line, to which a sixth potential generated by a voltage conversion circuit based on a difference between the first and fifth potentials is supplied, are connected.

A display device according to an embodiment of the present invention comprises:

one of the above power supply circuits;

the source electrode driver circuit with which the first and fourth power supply lines are connected;

a voltage conversion circuit with which the first and fifth power supply lines are connected and which supplies a sixth potential generated based on a difference between the first and second potentials to a sixth power supply line; and the gate electrode driver circuit with which the first, fifth, and sixth power supply lines are connected.

In the display device, the sixth potential may be negative based on the first potential.

With the display device, since a voltage necessary for the gate electrode driver circuit can be supplied by the positive potential generated by the power supply circuit and the sixth potential, a potential which should be generated by the power supply circuit can be decreased. Therefore, the power supply circuit can be manufactured by-using a higher definition, low voltage process.

In the display device, the voltage conversion circuit may comprise:

a p-type transistor, a source terminal of which is connected with the first potential;

a first capacitor which capacitively couples a first node to which a first booster clock is supplied and a gate terminal of the p-type transistor;

a first level shifter which is connected between the source terminal of the p-type transistor and the gate terminal of the p-type transistor;

an n-type transistor, a drain terminal of which is connected with a drain terminal of the p-type transistor, and a source terminal of which is connected with a second node;

a second capacitor which capacitively couples the first potential and the second node;

a third capacitor which capacitively couples a third node to which a second booster clock is supplied and a gate terminal of the n-type transistor;

a second level shifter which is connected between the source terminal of the n-type transistor and the gate terminal of the n-type transistor; and a fourth capacitor which capacitively couples a fourth node to which a given potential is supplied and the drain terminal of the n-type transistor, the first booster clock may fall after the second booster clock has fallen, and the second booster clock may rise after the first booster clock has risen, the potential supplied to the fourth node may change to a fifth potential, which is positive based on the first potential, in synchronization with fall of the first booster clock, and may change to the first potential in synchronization with rise of the second booster clock, and the source terminal of the n-type transistor may be connected with the sixth power supply line through the n-type switching transistor.

The two signals change in synchronization. This means that the two signals change almost at the same time (at the same timing), or while maintaining a constant relation therebetween.

According to the embodiment, since the voltage conversion circuit can be formed by using two transistors, four capacitors, and two level shifters, the circuit configuration can be simplified while achieving the above effects.

For example, an appropriate common potential (VCOM) which is applied to a common electrode opposite to the pixel electrode in the display device can be supplied with a very simple configuration to the display device in which an auxiliary capacitance is formed by using a storage capacitance method in order to compensate for holding characteristics of the liquid crystal.

In the display device, the voltage conversion circuit may comprise:

a fifth capacitor which capacitively couples a fifth node to which a timing signal changing between given potentials is supplied and the sixth power supply line;

a negative power supply generating circuit which generates a sixth potential which is negative based on the first potential based on a difference between the first and fifth potentials; and a switching element which is inserted between a node to which the sixth potential generated by the negative power supply generating circuit is supplied and the sixth power supply line, and controlled based on a given switching control signal, the timing signal and the switching control signal may change in synchronization with each other.

With the display device, the fifth capacitor which capacitively couples the node to which the timing signal is supplied and the output power supply line, and the switching element which is inserted between the node to which the sixth potential is supplied and the sixth power supply line are provided. The timing signal is synchronized with the switching control signal which controls the switching element. Therefore, the sixth potential supplied to the sixth power supply line through the switching element can be obtained as an output potential which changes in synchronization with the timing signal. Moreover, even in the case where the power supply circuit which generates the fifth potential which is positive based on the first potential has a low voltage, a high voltage can be supplied between the fifth potential and the sixth potential which is negative based on the first potential generated by the voltage conversion circuit. As a result, the manufacturing cost of the power supply circuit can be decreased.

As the timing signal, a polarity inversion timing signal for the common potential (VCOM) applied to the common electrode opposite to the pixel electrode in the display device can be applied. In this case, a potential which causes appropriate polarity inversion can be generated for the display device in which an auxiliary capacitance is formed by using an additional capacitance method in order to compensate for holding characteristics of the liquid crystal.

In the display device, the switching element may be an n-type switching transistor, the negative power supply generating circuit may comprise:

a p-type transistor, a source terminal of which is connected with the first potential;

a first capacitor which capacitively couples a first node to which a first booster clock is supplied and a gate terminal of the p-type transistor;

a first level shifter which is connected between the source terminal of the p-type transistor and the gate terminal of the p-type transistor;

an n-type transistor, a drain terminal of which is connected with a drain terminal of the p-type transistor, and a source terminal of which is connected with a second node;

a second capacitor which capacitively couples the first potential and the second node;

a third capacitor which capacitively couples a third node to which a second booster clock is supplied and a gate terminal of the n-type transistor;

a second level shifter which-is connected between the source terminal of the n-type transistor and the gate terminal of the n-type transistor; and a fourth capacitor which capacitively couples a fourth node to which a given potential is supplied and the drain terminal of the n-type transistor, the first booster clock may fall after the second booster clock has fallen, and the second booster clock may rise after the first booster clock has risen, the potential supplied to the fourth node may change to a fifth potential, which is positive based on the first potential, in synchronization with fall of the first booster clock, and may change to the first potential in synchronization with rise of the second booster clock, and the source terminal of the n-type transistor may be connected with the sixth power supply line through the n-type switching transistor.

The first booster clock falls after the second booster clock has fallen, and the second booster clock rises after the first booster clock has risen. This means that a period in which the n-type transistor is turned ON (period in which the transistor is active) and a period in which the p-type transistor is turned ON do not overlap each other.

Since the negative power supply generating circuit can be formed by using two transistors, four capacitors, and two level shifters, the circuit configuration can be simplified while achieving the above effects.

A semiconductor device according to an embodiment of the present invention comprises one of the above power supply circuits, and the source electrode driver circuit with which the first and fourth power supply lines are connected.

With the semiconductor device, a demand for application to electronic equipment for which a semiconductor enabling compact mounting is needed, such as portable telephones, portable information terminals, or game devices can be satisfied by forming a source driver including the power supply circuit as one chip of semiconductor device.

A potential necessary for the gate electrode driver circuit is from about −15 V to +15 V, for example. The semiconductor device according to the present embodiment includes a memory and a, logic circuit. A semiconductor circuit is formed by using a high definition, low voltage process for forming the memory and the logic circuit. This limits the voltage of the entire chip. A high voltage process is necessary for the power supply circuit. Therefore, it is difficult to provide a chip in which a power supply circuit capable of outputting a potential ranging from −15 V to +15 V and a memory and the like are embedded. Because of this, a semiconductor device in which the source electrode driver circuit and the power supply circuit are embedded has not been provided.

Therefore, the potential ranging from 0 V to +15 V is supplied to the gate electrode driver circuit from the power supply circuit included in the semiconductor device, and the potential ranging from −15 V to 0 V is supplied to the gate electrode driver circuit from the voltage conversion circuit by applying the semiconductor device according to the present embodiment, for example. This enables provision of a semiconductor device in which the source electrode driver circuit and the power supply circuit are embedded.

The semiconductor device may comprise an external component connection terminal of the power supply circuit which is disposed on a second side opposite to a first side of the semiconductor device on which an electrode for driving the source electrode is disposed; and a terminal, with which the fifth power supply line is connected, is disposed on at least one of a third side and a fourth side of the semiconductor device which intersect the first and second sides.

The power supply line and the like can be wired between the semiconductor device and the gate electrode driver circuit in the shortest distance, even if the gate electrode driver circuit is disposed on either the left or the right of the semiconductor device depending upon the mounting state of the display device, whereby the mounting area can be effectively decreased.

The semiconductor device may comprise:

a plurality of the source electrodes including a first to k-th and (k+1)th to Nth source electrodes ($1 \leqq k < N$, k is a natural number);

a first RAM which stores display data for driving the first to k-th source electrodes; and a second RAM which stores display data for driving the (k+1)th to Nth source electrodes, the power supply circuit may be disposed in a region between the first RAM and the second RAM.

With the semiconductor device, the power supply circuit which generates the fifth potential supplied to the fifth power supply line is disposed at a position whereby load is equal based on the third and fourth sides SD3 and SD4. Therefore, if a circuit to which a power supply is supplied is disposed on either the left or the right of the semiconductor device, the power supply can be provided through power supply lines having equal load.

An embodiment of the present invention further provides a voltage conversion circuit which generates an output potential that is negative based on a first potential, comprising:

a capacitor which capacitively couples a node to which a timing signal changing between given potentials is supplied and an output power supply line to which the output potential is supplied;

a negative power supply generating circuit which generates a negative potential based on the first potential based on a difference between the first potential and an input potential which is positive based on the first potential; and a switching element which is inserted between a node to which the negative power supply potential is supplied and the output power supply line, and controlled based on a given switching control signal, wherein the timing signal and the switching control signal change in synchronization with each other.

Electronic equipment according to an embodiment of the present invention comprises the above voltage conversion circuit.

Electronic equipment according to an embodiment of the present invention comprises:

a power supply circuit which includes: a first booster circuit which is connected with first and second power supply lines, which respectively supply first and second potentials, and supplies a third potential which is boosted based on a difference between the first and second potentials to a third power supply line; a potential regulator circuit which is connected with the first and third power supply lines and supplies a fourth potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line; and the above voltage conversion circuit with which the first and fifth power supply lines are connected, wherein the fifth potential supplied to the fifth power supply line is used as an input potential to the voltage conversion circuit.

With the electronic equipment, cost of the electronic equipment can be decreased by applying the above voltage conversion circuit. Moreover, the power supply circuit can be manufactured by using a high definition process by allowing the voltage conversion circuit and the power supply circuit which generates only a negative potential based on the first potential to provide a power supply in cooperation, whereby costs of the power supply circuit and the electronic equipment can be decreased.

Electronic equipment according to an embodiment of the present invention may comprise the above display device.

According to the present embodiment, cost of the electronic equipment can be decreased by applying the above display device.

1. Display Device

FIG. 1 is a view showing an example of the configuration of a display device of the present embodiment.

A display device 2 includes a semiconductor device (IC) 3 as a source driver IC, a display panel body 4, and a gate driver 6.

The display panel body 4 includes a plurality of source electrodes 20 which are arranged in the X direction and extend in the Y direction, and a plurality of gate electrodes 22 which are arranged in the Y direction and extend in the X direction. Each pixel is specified by the source electrode 20 and the gate electrode 22.

Each pixel has an active driver element. In the case where a thin film transistor (TFT) liquid crystal panel is used as the display panel body 4, the display panel body 4 has a TFT 30 as the active driver element for each pixel. The gate electrode is connected with a gate terminal of the TFT 30. The source electrode is connected with a source (drain) terminal of the TFT 30. A liquid crystal 32 and a storage capacitance 34 are connected in parallel with a drain (source) terminal of the TFT 30. The other ends of the liquid crystal 32 and the storage capacitance 34 are connected with common electrodes, for example.

The semiconductor device (source driver IC) 3 includes a source driver 8, a drive control circuit 12, a memory (RAM) 14, and a power supply circuit 100.

The source driver 8 drives one of a plurality of source electrodes 20 based on display data. The source driver 8 includes a gamma correction circuit and drives the source electrode 20 by generating a potential for performing gamma correction.

The drive control circuit 12 controls the electrode drive timing by the gate driver 6 and the source driver 8.

The memory (display data RAM) 14 stores display data of an image to be displayed in the display panel body 4. The source driver 8 drives the source electrode 20 in a unit of one or more source electrodes based on the display data stored in the memory 14.

The power supply circuit 100 generates various levels of potential by using a system power supply potential VDD and a grounding power supply potential VSS supplied from the outside. The power supply circuit 100 supplies the potential to each section of the display device 2. In more detail, the power supply circuit 100 supplies a potential necessary for polarity inversion drive to the common electrode 24 of the display panel body 4. The power supply circuit 100 supplies a potential necessary for driving the source electrode 20 to the source driver 8 in the semiconductor device 3. The power supply circuit 100 supplies a necessary potential to the drive control circuit 12 and the memory 14.

The power supply circuit 100 supplies a positive potential based on the grounding power supply potential VSS among the potentials necessary for driving the gate electrode 22 to the gate driver 6. Therefore, the display device 2 of the present embodiment further includes a voltage conversion circuit 40. The voltage conversion circuit 40 generates a negative potential based on the grounding power supply potential VSS by using the potential generated by the power supply circuit 100 of the semiconductor device 3, and supplies the negative potential to the gate driver 6.

In the display device 2, the positive and negative potentials based on the grounding power supply potential VSS are supplied to the gate driver 6, for which a potential higher than that of the source driver 8 is needed, respectively from the power supply circuit 100 included in the semiconductor device 3 together with the source driver 8 and from the voltage conversion circuit 40 formed independently.

Therefore, the potential to be supplied from the power supply circuit 100 to the gate driver 6 can be decreased. Moreover, the absolute voltage of a regulator circuit of the power supply circuit 100 which regulates the potential supplied to the gate driver 6 can be decreased. As a result, the voltage of the semiconductor device 3 as the source driver IC can be decreased, whereby the degree of integration of the source driver IC can be increased by using a higher definition, low voltage process.

In a display panel (display) having an active driver element in the pixel such as a TFT liquid crystal panel (display panel), orientation of the liquid crystal is determined depending on the potential supplied to the source electrode. This considerably affects the quality of the gray scale or color display. Therefore, a highly precise potential must be supplied to the source driver which generates the potential supplied to the source electrode.

In the case where the number of pixels in the X direction of the display panel body 4 is 176, the number of pixels in the Y direction is 228, and each pixel consists of three dots (R, G, B), a current consumption $I_{PIN}$ is expressed by the following equation (1).

$$I_{PIN}=2\ \mu A\times 528=1056\ \mu A \quad (1)$$

The source driver which drives the source electrode has a current consumption $I_{LOAD}$ in which a current consumption $I_{PANEL}$ due to panel load is added to the current consumption $I_{PIN}$.

In the case of driving a parasitic capacitance of 10 pF per line every 1/30 second at a power supply of 5 V, the current consumption $I_{PANEL}$ due to the panel load is expressed by the following equation (2).

$$I_{PANEL}=fCV=30\times 228/2\times 10\ pF\times 528\times 5\ V\approx 90\ \mu A \quad (2)$$

Therefore, the current consumption $I_{LOAD}$ is expressed by the following equation (3).

$$I_{LOAD}=I_{PIN}+I_{PANEL}\approx 1146\ \mu A \quad (3)$$

If the parasitic capacitance of the common electrode is 15000 pF, a potential VCOMH/VCOML supplied to the common electrode has the following current consumption $I_{VCOM}$ due to panel load.

$$I_{VCOM}=30\times 228/2\times 15000\ pF\times 5\ V=256.5\ \mu A \quad (4)$$

Therefore, a potential to be originally supplied to the source driver or the common electrode significantly changes due to a large amount of current consumption caused by load applied to the source driver or the common electrode. Because of this, the potential must be supplied to the source driver through the regulator circuit (potential regulator circuit).

Since it suffices that the potential supplied to the gate electrode only controls the gate of the active driver element (ON/OFF control of the gate terminal), it is unnecessary for the potential supplied to the gate electrode to be as precise as the potential supplied to the source electrode.

For example, the number of gate electrodes selected by the gate driver 6 is merely one and its maximum capacitance is 50 pF. Therefore, the gate driver 6 at a power supply of 30 V only has a current consumption expressed by the following equation (5).

$$I_{GATE}=30\times 228/2\times 50\ pF\times 30\ V=5.13\ \mu A \quad (5)$$

Since the potential VDDHG supplied to the gate driver 6 shows almost no change in current caused by load and the precision of the potential necessary for ON/OFF control of the gate can be low, a boosted potential can be supplied without using the regulator circuit (potential regulator circuit).

The power supply circuit 100 may have a configuration described below taking the above characteristics into consideration.

2. Power Supply Circuit

Figure 2:
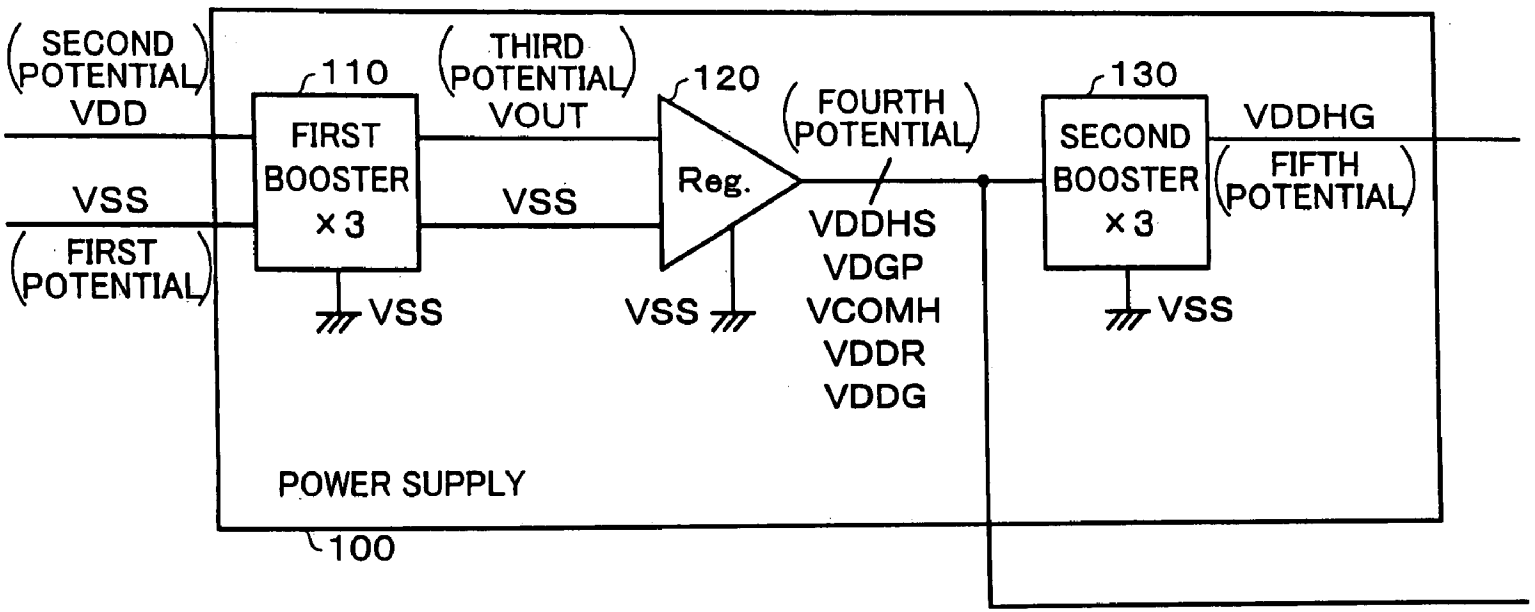
FIG. 2 is a block diagram showing the power supply circuit of the present embodiment.

FIG. 2 is a view showing an outline of the configuration of the power supply circuit 100 of the present embodiment.

The power supply circuit 100 includes a first booster circuit 110, a regulator circuit (potential regulator circuit in a broad sense) 120, and a second booster circuit 130.

The first booster circuit 110 is connected with a first power supply line which supplies the grounding power supply potential VSS (first potential) and a second power supply line which supplies a system power supply potential VDD (second potential). The first booster circuit 110 triple-boosts the difference between the system power supply potential VDD (second potential) and the grounding power supply potential VSS (first potential) to generate a potential VOUT (third potential), and supplies the third potential to a third power supply line, for example.

The regulator circuit (potential regulator circuit) 120 is connected with the first power supply line which supplies the grounding power supply potential VSS (first potential) and the third power supply line which supplies the potential VOUT (third potential). The regulator circuit. 120 generates potentials VDDHS, VDGP, VCOMH, VDDR, and VDDG (fourth potentials) which are constant potentials, and supplies the fourth potentials to a fourth power supply line.

The fourth potentials must be precise and are supplied to each section and the source driver 8 in the semiconductor device 3 including the power supply circuit 100.

The second booster circuit 130 is connected with the first power supply line which supplies the grounding power supply potential VSS (first potential) and the fourth power supply line which supplies the fourth potential which is a constant potential (one of the potentials VDDHS, VDGP, VCOMH, VDDR, and VDDG). The second booster circuit 130 triple-boosts the difference between the fourth potential and the grounding power supply potential VSS (first potential) to generate a potential VDDHG (fifth potential), and supplies the fifth potential to a fifth power supply line, for example.

The fifth potential is supplied to the gate driver 6 for which a highly precise potential is not needed.

Each section of the power supply circuit 100 is described below.

Figure 3:
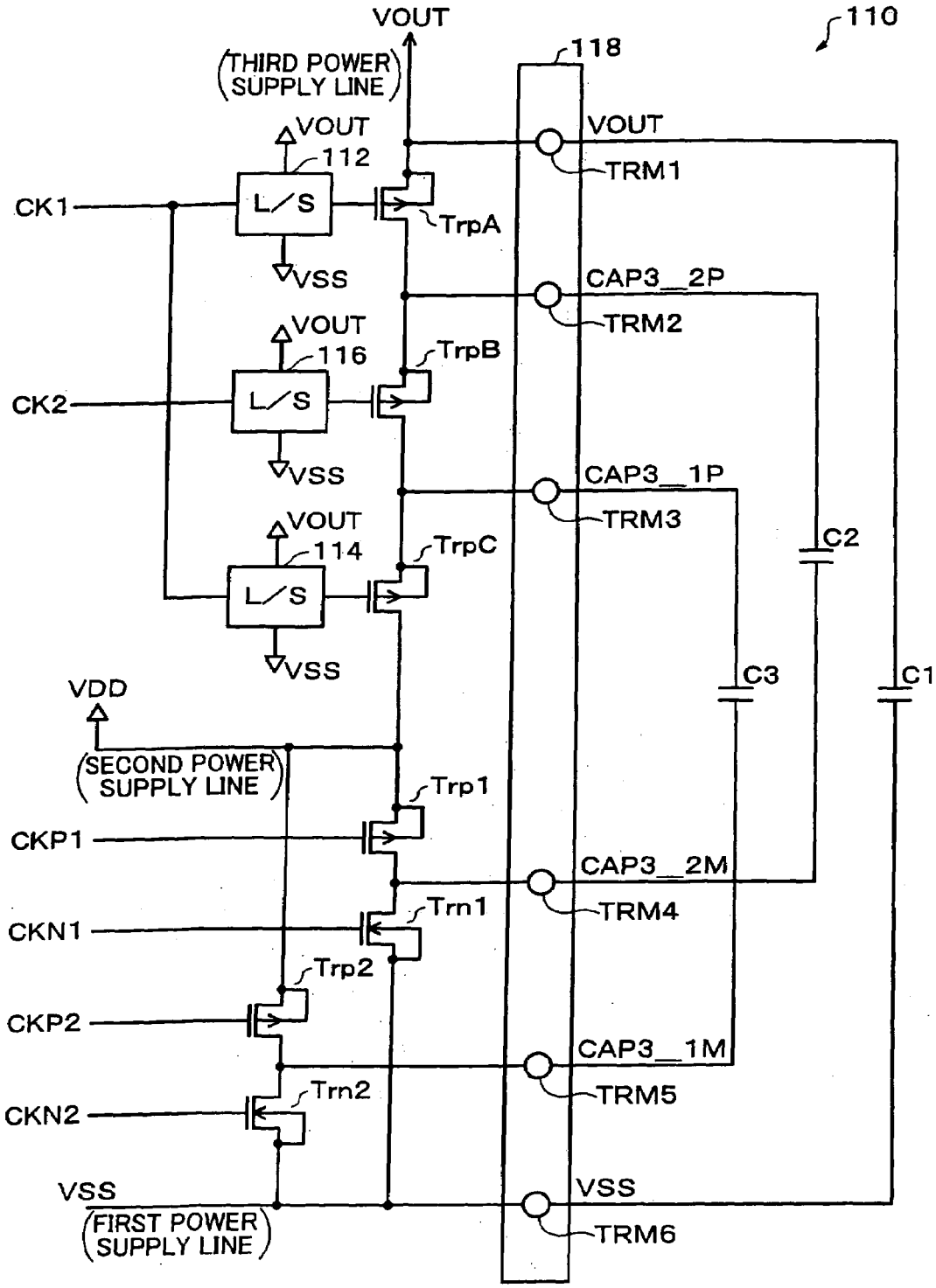
FIG. 3 is a configuration diagram showing an example of the feature of the configuration of a first booster circuit.

FIG. 3 is a view showing an example of the feature of the configuration of the first booster circuit 110.

In the first booster circuit 110, a p-type (first conductivity type) MOS transistor Trp1, an n-type (second conductivity type) MOS transistor Trn1, a p-type MOS transistor Trp2, and an n-type MOS transistor Trn2 are connected between the first power supply line and the second power supply line. Drain terminals of the p-type MOS transistor Trp1 and the n-type MOS transistor Trn1 are connected in common, and drain terminals of the p-type MOS transistor Trp2 and the n-type MOS transistor Trn2 are connected in common.

In the first booster circuit 110, p-type MOS transistors TrpA to TrpC are connected in series between the third power supply line and the second power supply line by connecting drain terminals and source terminals of the p-type MOS transistors TrpA to TrpC in common.

A booster clock (control signal in a broad sense) CK1 is supplied to gate terminals of the p-type MOS transistors TrpA and TrpC through level shifters (L/S) 112 and 114. A booster clock CK2 is supplied to a gate terminal of the p-type MOS transistor TrpB through an L/S 116. The grounding power supply potential VSS and the potential VOUT are supplied to the L/S 112, 114, and 116. The L/S 112, 114, and 116 convert a signal which is changed by the potential difference between the potential VDD and the potential VSS into a signal which is changed by the potential difference between the potential VOUT and the potential VSS.

Booster clocks CKP1, CKN1, CKP2, and CKN2 are respectively supplied to gate terminals of the p-type MOS transistor Trp1, the n-type MOS transistor Trn1, the p-type MOS transistor Trp2, and the n-type MOS transistor Trn2.

As shown in FIG. 3, external components provided outside the semiconductor device 3 including the power supply circuit 100 are connected with the first booster circuit 110 through external component connection terminals 118.

Figure 4:
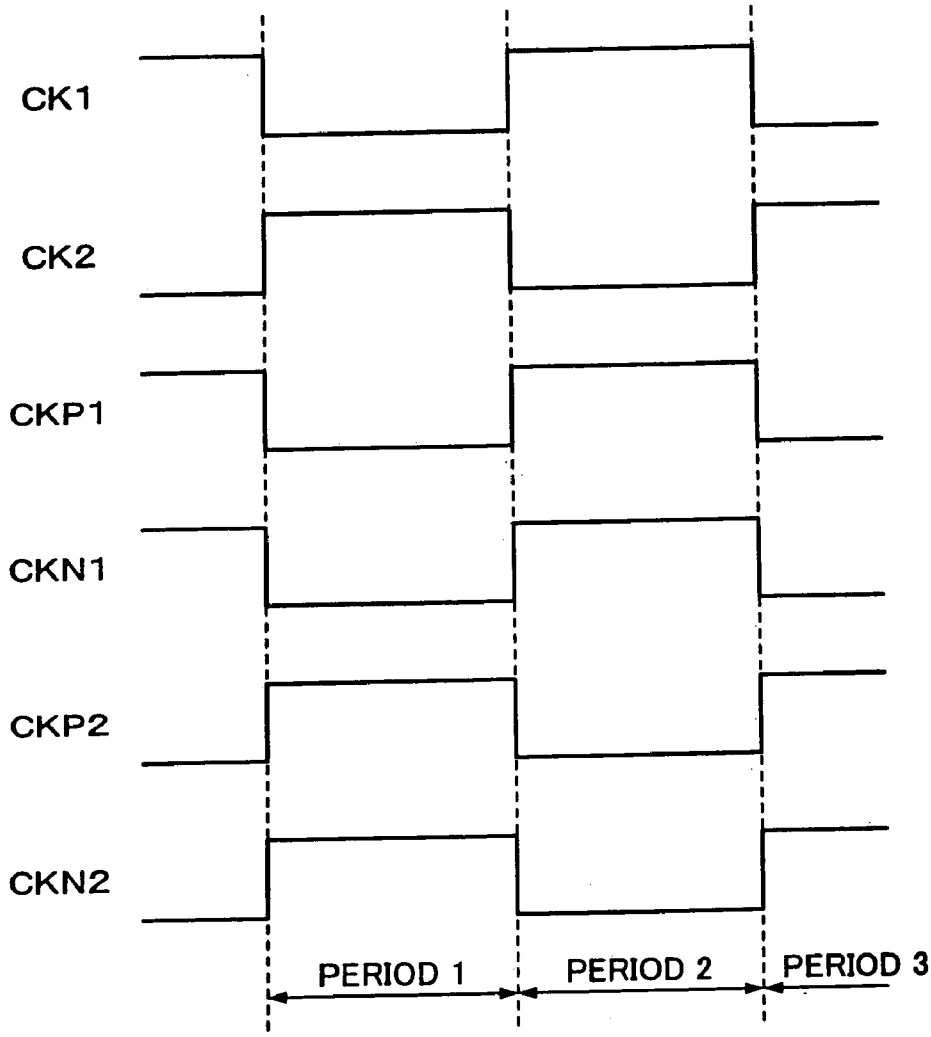
FIG. 4 is a timing chart of a booster clock for boost control of the first booster circuit.

As shown in FIG. 4, the booster clocks CK1, CK2, CKP1, CKN1, CKP2, and CKN2 which control triple boosting are supplied to each MOS transistor of the first booster circuit 110. These booster clocks may be generated in the first booster circuit 110 based on a given reference booster clock signal, for example.

In a period 1 shown in FIG. 4, since the booster clock CK1 is at a logic level "L" in the first booster circuit 110, the p-type MOS transistors TrpA and TrpC are turned ON. Since the booster clock CK2 is at a logic level "H", the p-type MOS transistor TrpB is turned OFF. Since the booster clocks CKP2 and CKN2 are at a logic level "H", the p-type MOS transistor Trp2 is turned OFF and the n-type MOS transistor Trn2 is turned ON.

One end of the capacitor C3 is set at a potential almost the same as the potential of the first power supply line (VSS) through the n-type MOS transistor Trn2 which is in a conducting state. The other end of the capacitor C3 is set at a potential almost the same as the potential of the second power supply line (VDD) through the p-type MOS transistor TrpC which is in a conducting state. Therefore, the potential difference across the capacitor C3 is 1×VDD based on the potential VSS.

In a period 2 shown in FIG. 4, since the booster clock CK1 is at a logic level "H" in the first booster circuit 110, the p-type MOS transistors TrpA and TrpC are turned OFF. Since the booster clock CK2 is at a logic level "L", the p-type MOS transistor TrpB is turned ON. Since the booster clocks CKP2 and CKN2 are at a logic level "L", the p-type MOS transistor Trp2 is turned ON and the n-type MOS transistor Trn2 is turned OFF.

One end of the capacitor C3 which is set at the potential VSS in the period 1 is increased to the potential VDD since the p-type MOS transistor Trp2 is turned ON. The potential of the other end of the capacitor C3 having a potential difference of 1×VDD is increased for the potential VDD and becomes 2×VDD. This causes one end of the capacitor C2 to be set at a potential 2×VDD through the p-type MOS transistor TrpB which is in a conducting state. The n-type MOS transistor Trn1 is turned ON when the booster clock CKN1 is at a logic level "H", whereby the other end of the capacitor C2 is set at a potential almost the same as the potential of the first power supply line (VSS). Therefore, the potential difference across the capacitor C2 is 2×VDD based on the potential VSS.

In a period 3 shown in FIG. 4, since the booster clock CK1 is at a logic level "L" in the first booster circuit 110, the p-type MOS transistor TrpA is turned ON. Since the booster clock CK2 is at a logic level "H", the p-type MOS transistor TrpB is turned OFF. Since the booster clocks CKP1 and CKN1 are at a logic level "L", the p-type MOS transistor Trp1 is turned ON and the n-type MOS transistor Trn1 is turned OFF.

One end of the capacitor C2 which is set at the potential VSS in the period 2 is increased to the potential VDD since the p-type MOS transistor Trp1 is turned ON. The potential of the other end of the capacitor C2 having a potential difference of 2×VDD is increased for the potential VDD and becomes 3×VDD. This causes one end of a capacitor C1 to be set at a potential 3×VDD through the p-type MOS transistor TrpA which is in a conducting state. The other end of the capacitor C1 is fixed at a potential the same as the potential of the first power supply line (VSS).

Therefore, the potential difference across the capacitor C1 is 3×VDD based on the potential VSS, and the potential VOUT of the third power supply line is 3×VDD based on the grounding power supply potential VSS.

Figure 5:
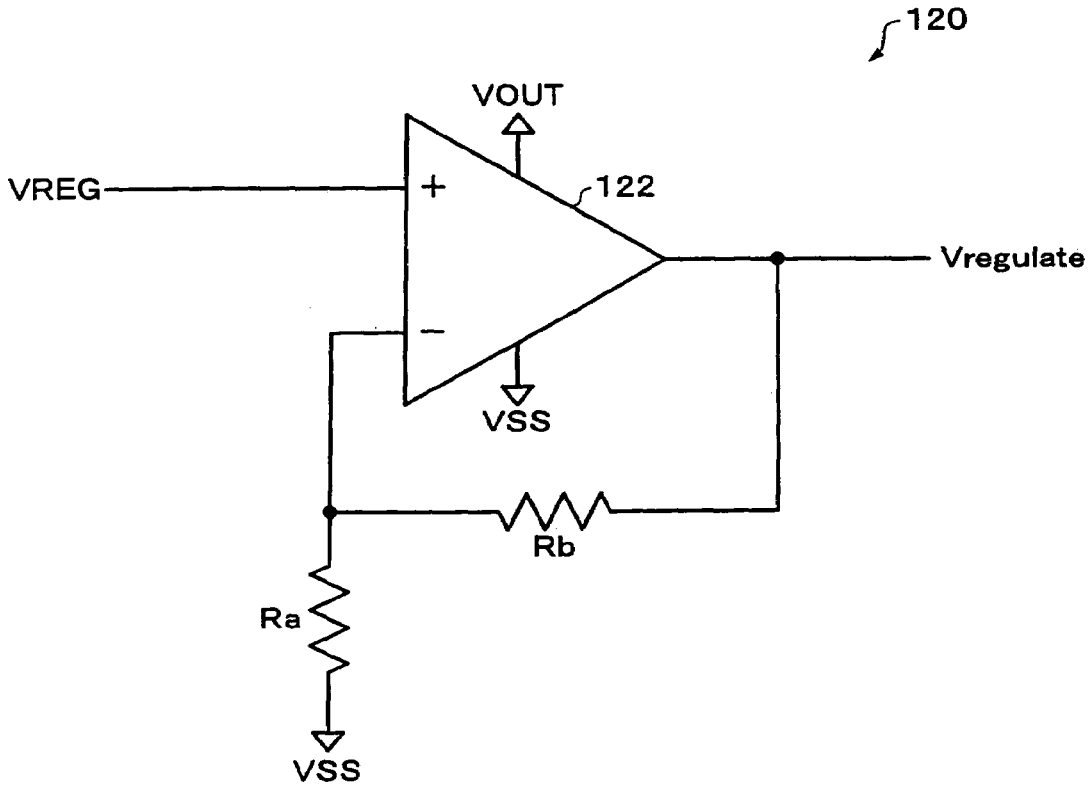
FIG. 5 is a configuration diagram showing an example of the configuration of a regulator circuit (potential regulator circuit) of the present embodiment.

FIG. 5 shows an example of the configuration of the regulator circuit (potential regulator circuit) 120.

The regulator circuit 120 includes an operational amplifier 122, and voltage regulating resistors Ra and Rb.

The operational amplifier 122 operates based on the potential difference between the third potential generated by the first booster circuit 110 and the grounding power supply potential VSS. A reference potential VREG generated by a given reference voltage generating circuit (not shown) is supplied to a noninverting input terminal (+terminal) of the operational amplifier 122. An inverting input-terminal (−terminal) of the operational amplifier 122 is connected with the first power supply line through the voltage regulating resistor Ra. The inverting input terminal and an output terminal of the operational amplifier 122 are connected through the voltage regulating resistor Rb.

The output terminal of the operational amplifier 122 is connected with the fourth power supply line.

The regulator circuit 120 having the above configuration generates a regulated (constant) potential Vregulate by noninverting amplification of the reference potential (VREG) as shown by the following equation (6).

$$V\text{regulate}=V\text{REG}\cdot(1+Rb/Ra) \quad (6)$$

The regulator circuit 120 is provided for each of the fourth potentials VDDHS, VDGP, VCOMH, VDDR, and VDDG which are constant potentials. Each of the regulator circuits 120 is designed so that the values or ratio of the voltage regulating resistors Ra and Rb is adjusted by parameters of electronic volume commands.

The configuration and the operation of the second booster circuit 130, which triple-boosts the voltage based on the difference between the fourth potential regulated by the regulator circuit 120 and the grounding power supply potential VSS, are the same as those of the first booster circuit 110 shown in FIG. 2 in principle. Therefore, description of the second booster circuit 130 is omitted.

In the second booster circuit 130, the fifth potential VDDHG is generated by applying VDGP among the fourth potentials generated by the regulator circuit 120 instead of the second potential VDD in FIG. 3. As a result, a potential of 3×VDGP is supplied to the fifth power supply line as the fifth potential.

Figure 6:
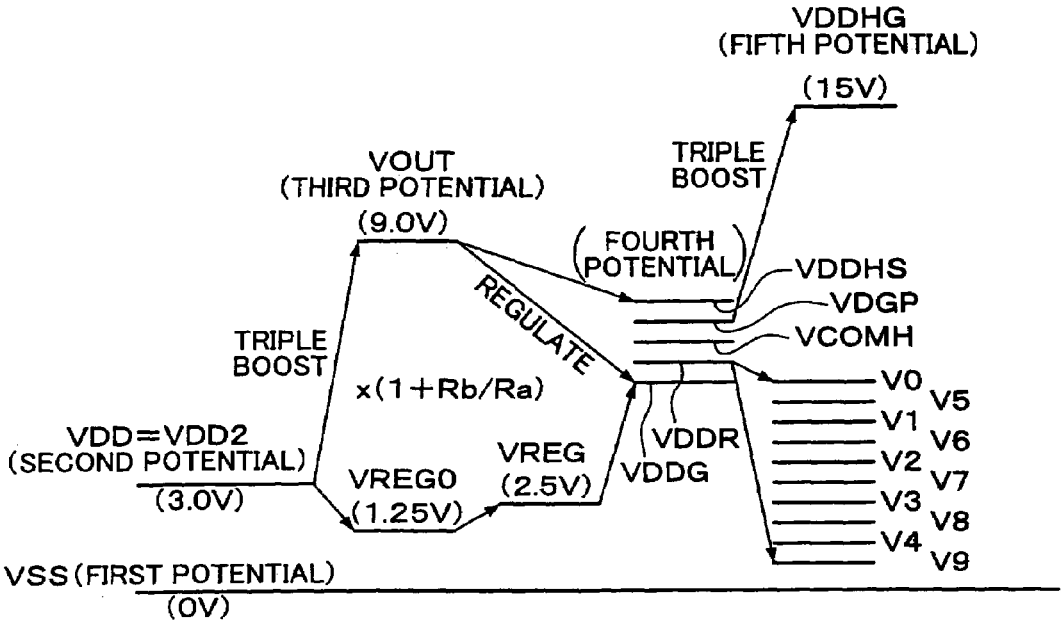
FIG. 6 is an explanatory diagram showing the relation between potentials generated by the power supply circuit of the present embodiment.

FIG. 6 shows the relation between the potentials generated by the power supply circuit.

The potential VDD (second potential) is the power supply for a logic power supply circuit and used in common with the system power supply Vcc.

The grounding power supply potential VSS (first potential) is connected with a system GND at a grounding level, and also becomes a substrate potential of the semiconductor device (IC) 3.

The potential VDDHS among the fourth potentials is a power supply used by the source driver (source electrode driver circuit).

The potential VCOMH among the fourth potentials supplies an "H" level power supply of a CMO signal (signal which drives the common electrode). In the present embodiment, the potential VCOML for supplying an "L" level power supply of the CMO signal is generated as a potential regulated by noninverting amplification of the potential VREG0 generated by a given reference voltage circuit.

The potential VDDG among the fourth potentials is a logic power supply used in a logic section of the gate driver (gate electrode driver circuit).

The potential VDGP among the fourth potentials is a potential which becomes a reference for the second booster circuit.

The potential VDDHG (fifth potential) is a positive power supply for the gate driver.

The potential VDDR among the fourth potentials is a power supply which is supplied to gamma correction resistors of the gamma correction circuit. V0 to V9 are gamma correction power supplies.

Figure 7:
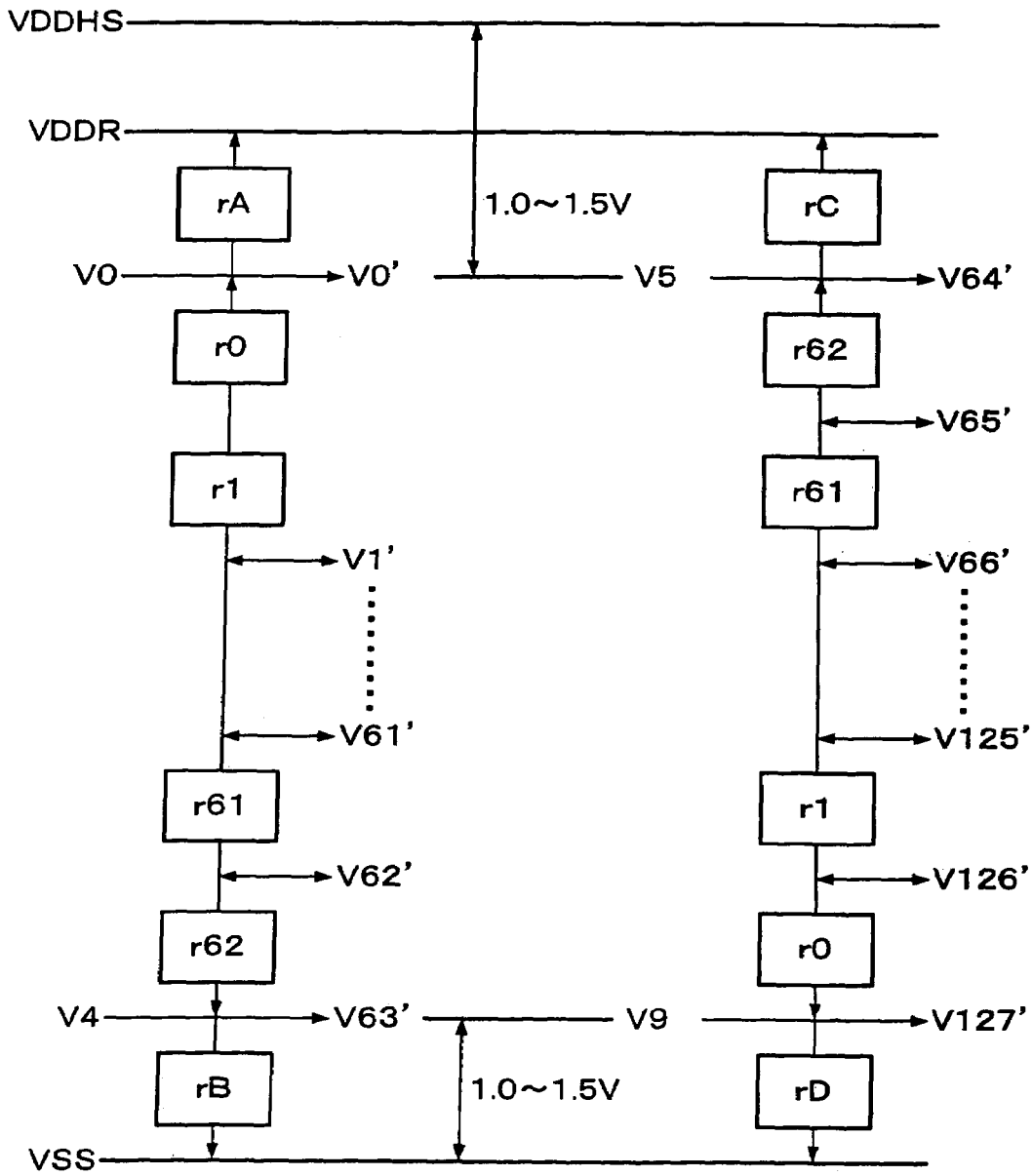
FIG. 7 is a view showing an outline of the configuration of a gamma correction circuit.

FIG. 7 shows an outline of the configuration of the gamma correction circuit.

The gamma correction circuit provided in the source driver 8 is a multi-level potential generating circuit which generates a plurality of potentials by the difference between the first potential (VSS) and the fourth potential (VDDR).

The gamma correction circuit generates 64-level×2 gamma correction potentials corresponding to polarity inversion for alternation by using resistor strings. The resistor strings are connected between VSS-and VDDR.

Since the power supply circuit 100 includes the regulator circuit 120 which supplies the third potential (VOUT) boosted by the first booster circuit 110 as the fourth potential (VDDHS, VDGP, etc.) which is a constant potential, a highly precise potential can be provided to the source driver. Moreover, since the potential is not regulated near the fifth potential (VDDHG) which is a comparatively high potential, a power supply circuit which consumes only a necessary small amount of power in the regulator circuit can be provided.

3. Source Driver IC Including Power Supply Circuit

Figure 8:
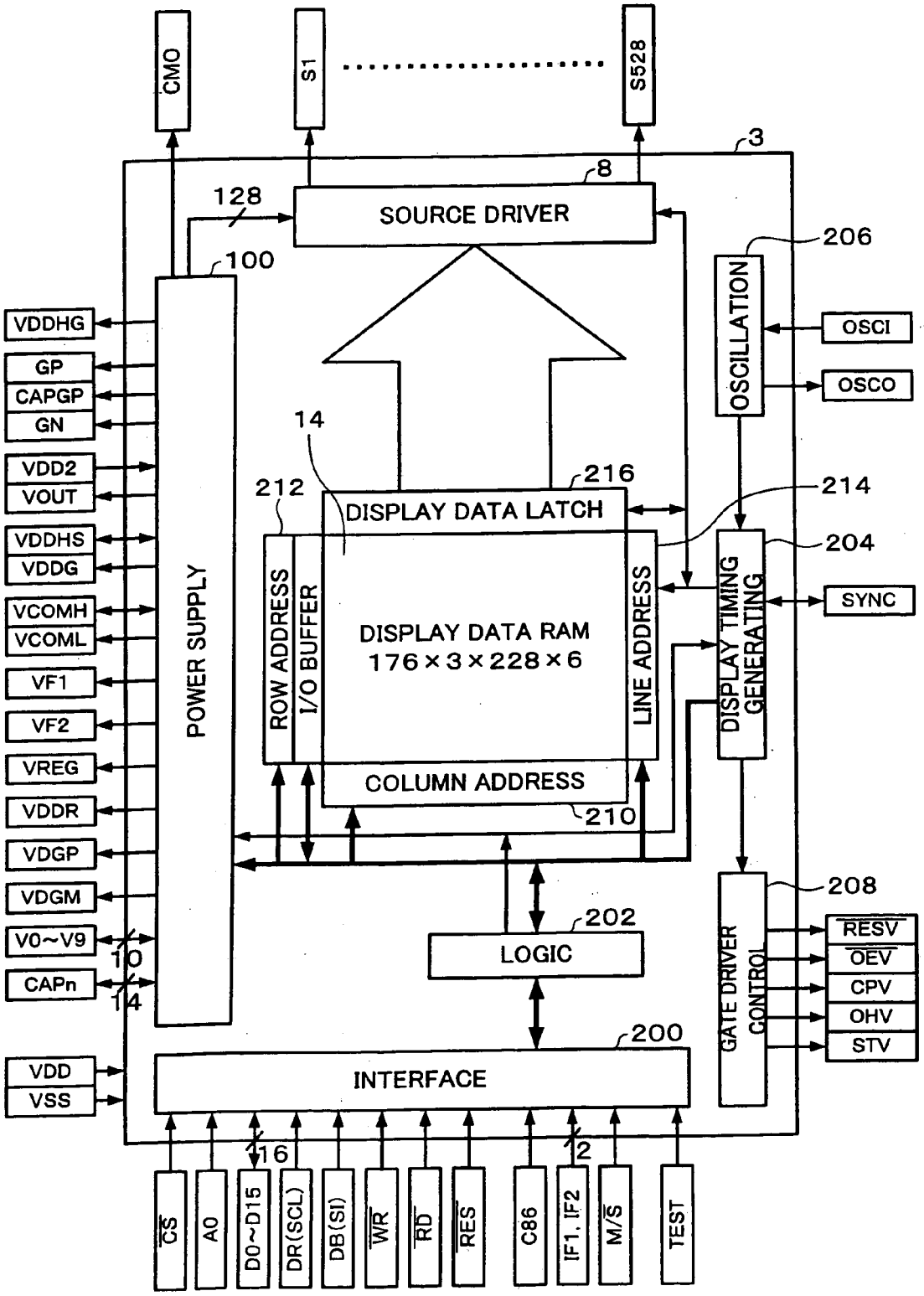
FIG. 8 is a functional block diagram of a source driver IC including the power supply circuit of the present embodiment.

FIG. 8 shows an example of functional blocks of the source driver IC including the power supply circuit of the present embodiment.

In FIG. 8, sections the same as those of the source driver IC (semiconductor device 3) shown in FIG. 1 are indicated by the same symbols. Description of these sections is appropriately omitted.

In this source driver IC, display data or various commands are input from an MPU (not shown) through an interface 200. The display data or commands input from the MPU are distinguished by a logic 202 and supplied to each corresponding section.

When the display data is input from the MPU, the display data is written in the display data RAM 14 at a timing specified by a display timing generating circuit 204 based on a reference clock generated by an oscillation circuit 206.

The display data RAM 14 stores display pixel data. One pixel consists of three dots (R, G, B). Each dot includes 6-bit gray scale data. If the displayable maximum screen size is 176×228 pixels, the capacity of the display data RAM 14 is 176×228×3×6 bits.

The storage region of the display data in the display data RAM 14 corresponds to the displayable area of the display panel body 4. For example, the storage location of the display data for driving a j-th source electrode among the first to Nth source electrodes 20 ($1 \leqq j \leqq N$, j is a natural number) is determined uniquely in the display data RAM 14.

The access region of the display data RAM 14 is defined by a rectangular region in which a start address and an end address are opposite vertices. The column address of the access region specified by the column addresses of the start address and the end address is controlled by a column address circuit 210. The row address of the access region specified by the row addresses of the start address and the end address is controlled by a row address circuit 212.

When display timing set commands are input from the MPU, the timing of the source driver 8, the display data RAM 14, a gate drive control circuit 208, and the power supply circuit 100 is set by the display timing generating circuit 204 based on the reference clock generated by the oscillation circuit 206.

As a result, the scan timing of the gate driver 6 is controlled by the gate drive control circuit 208. The display data of the line address controlled by a line address control circuit 214 is read from the display data RAM 14, and latched by a display data latch circuit 216. The source driver 8 drives the source electrode in a unit of one or more lines latched by the display data latch circuit 216.

When power control set commands are input from the MPU, ON/OFF setting of the first and second booster circuits 110 and 130 of the power supply circuit 100 or ON/OFF setting of the regulator circuits which generate various levels of potentials is performed.

When electronic volume set commands are input from the MPU, the ratio of the voltage regulating resistors of the regulator circuit 120 is set.

Figure 9:
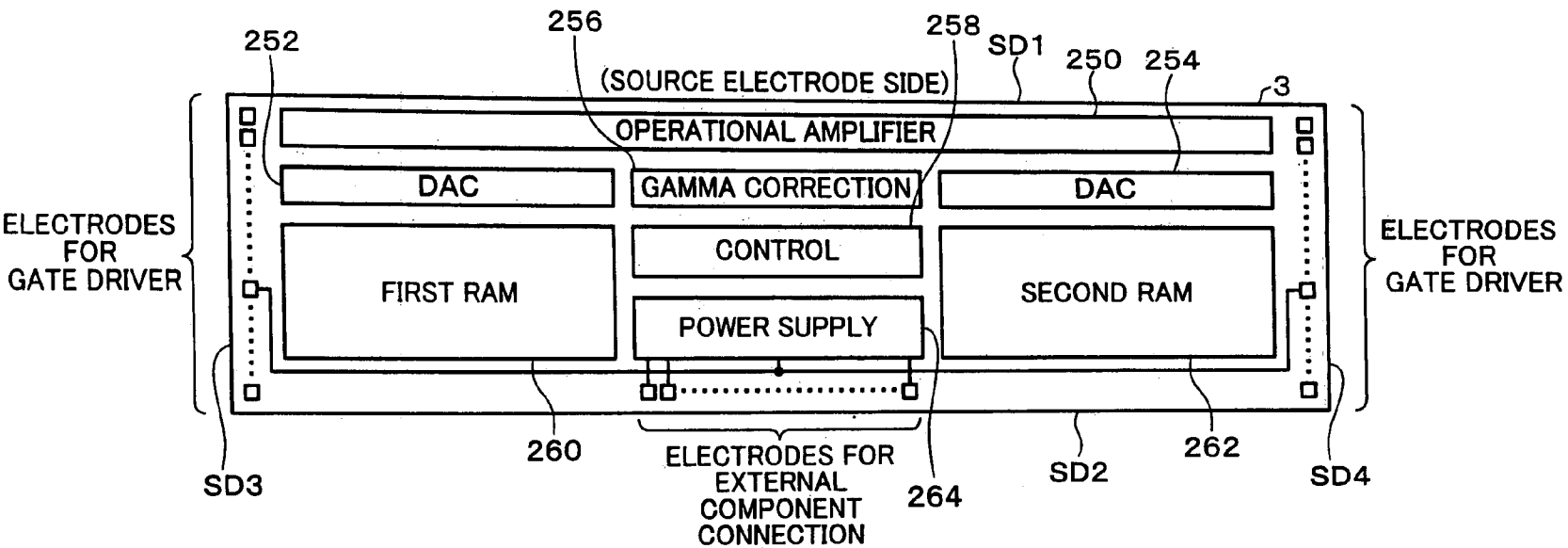
FIG. 9 is a view showing an example of a layout of the source driver IC including the power supply circuit of the present embodiment.

FIG. 9 is a view showing an example of the layout of the source driver IC having the above configuration.

The source driver IC (semiconductor device 3) includes an operational amplifier circuit section 250, a DAC circuit sections 252 and 254, a gamma correction circuit section 256, a control circuit section 258, first and second RAMs 260 and 262, and a power supply circuit section 264.

In the operational amplifier circuit section 250, first to Nth operational amplifier circuits for driving the first to Nth source electrodes of the display panel body 4 are disposed along the direction in which the source electrodes are arranged. The driver circuits which make up the source driver 8 shown in FIG. 8 are disposed in the operational amplifier circuit section 250.

In the DAC circuit section 252, first to k-th ($1 \leqq k < N$, k is a natural number) DAC circuits which supply an analog signal converted from a digital signal for driving the source electrode are disposed corresponding to the first to k-th operational amplifier circuits.

The (k+1)th to Nth DAC circuits which supply analog signals converted from digital signals for driving the source electrodes are disposed in the DAC circuit section 254 corresponding to the (k+1)th to Nth operational amplifier circuits.

The DAC circuits which make up the source driver 8 shown in FIG. 8 are disposed in the DAC circuit sections 252 and 254, for example.

A gamma correction circuit which generates a gamma correction potential is disposed in the gamma correction circuit section 256.

The logic 202, the control circuit of the source driver 8, the display timing generating circuit 204, and the gate drive control circuit 208 shown in FIG. 8, and the like are disposed in the control circuit section 258.

The power supply circuit 100 shown in FIG. 8 is disposed in the power supply circuit section 264.

A RAM which stores display data for driving the first to k-th source electrodes is disposed in the first RAM 260. Specifically, a RAM which stores display data for driving the first to k-th source electrodes in the display data RAM 14 shown in FIG. 8 is disposed in the first RAM 260.

A RAM which stores display data for driving the (k+1) th to Nth source electrodes is disposed in the second RAM 262. Specifically, a RAM which stores display data for driving the (k+1)th to Nth source electrodes in the display data RAM 14 shown in FIG. 8 is disposed in the second RAM 262.

In the source driver IC (semiconductor device 3), external component connection electrodes (terminals in a broad sense) of the power supply circuit 100 disposed in the power supply circuit section 264 are provided on a second side SD2 opposite to a first side SD1 on which electrodes for driving the source electrodes 20 are disposed. The capacitors for the first and second booster circuits shown in FIG. 3 and the voltage conversion circuit 40 shown in FIG. 1 are connected with the external component connection electrodes.

In the source driver IC (semiconductor device 3), electrodes for the gate driver 6 are provided on third and fourth sides SD3 and SD4 which intersect the first and second sides SD1 and SD2. The electrodes for the gate driver 6 include electrodes to which the power supply line (fifth power supply line) for supplying a power supply to the gate driver 6 is connected, and electrodes for supplying a control signal for driving the gate driver 6.

This enables the power supply line and the like to be wired between the source driver IC (semiconductor device 3) and the gate driver 6 at the shortest distance in the case where the source driver IC (semiconductor device 3) is electrically connected with the source electrodes of the display panel body 4 at a position shown in FIG. 1, even if the gate driver 6 is disposed on either the left or the right of the display panel body 4 depending upon the mounting state of the display device 2, whereby the mounting area can be effectively decreased.

Therefore, the electrodes for connecting the power supply line (fifth power supply line) for supplying a power supply to the gate driver 6 and the electrodes for supplying a control signal for driving the gate electrode are preferably disposed on both the third and fourth sides SD3 and SD4. This can be achieved by allowing the corresponding electrodes on opposite sides to be maintained at the same potential through interconnects.

The power supply circuit 100 in the power supply circuit section 264 which generates the fifth potential to be supplied to the fifth power supply line is preferably disposed at the center of the source driver IC (semiconductor device 3) so that the load is equal based on the third and fourth sides SD3 and SD4. The external component connection electrodes provided to the power supply circuit 100 are preferably provided to the power supply circuit section 264 in the area near the second side SD2.

In the case where the RAM is divided accompanied by an increase in the storage capacity of the display data RAM 14 in order to reduce load applied to read lines, the power supply circuit section 264 is preferably disposed between the regions in which the first and second RAMs 260 and 262 are disposed.

As described above, the source driver IC (semiconductor device 3) including the power supply circuit 100 generates only a positive potential based on the first potential (VSS), and the external voltage conversion circuit 40 supplies a negative potential to the gate driver 6. This enables the power supply circuit 100 to be included in the source driver IC (semiconductor device 3) by using a higher definition, low voltage process. Therefore, the number of parts of the display device 2 can be decreased.

4. Voltage Conversion Circuit

Since the power supply circuit 100 generates only the positive potential based on the grounding power supply potential VSS, the voltage of the source driver IC (semiconductor device 3) including the power supply circuit 100 can be decreased. In the present embodiment, a negative potential based on the grounding power supply potential VSS is generated by the external voltage conversion circuit (negative direction booster circuit) 40 separately from the power supply circuit 100 in order to provide a power supply to the gate driver 6 for which a high voltage of 30 V is needed, for example.

The voltage conversion circuit 40 is described below in detail.

In the display panel body 4, the image quality is increased by maintaining the voltage level of the pixel electrodes during a non-selected period. Therefore, a storage capacitance for supporting the liquid crystal (liquid crystal capacitance) is connected with the pixel electrode. As a method for forming such a storage capacitance, a storage capacitance method and an additional capacitance method can be given.

Figure 10A:
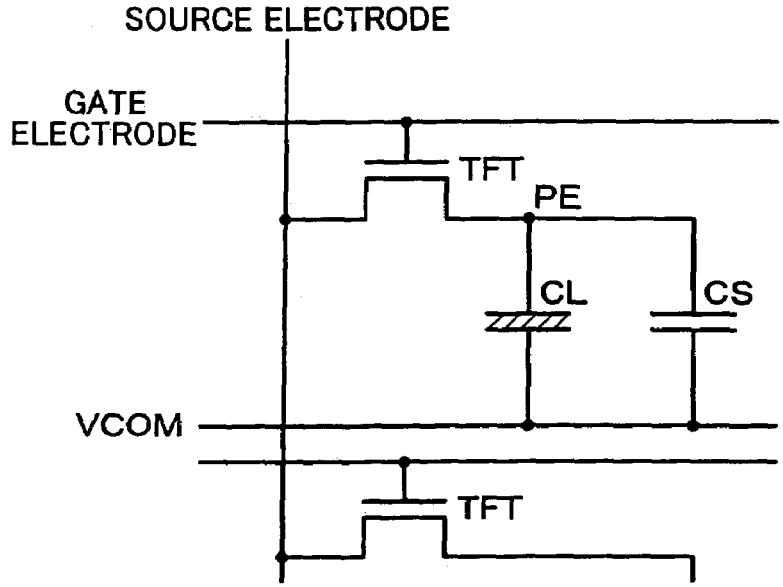
FIG. 10A illustrates a storage capacitance method.
Figure 10B:
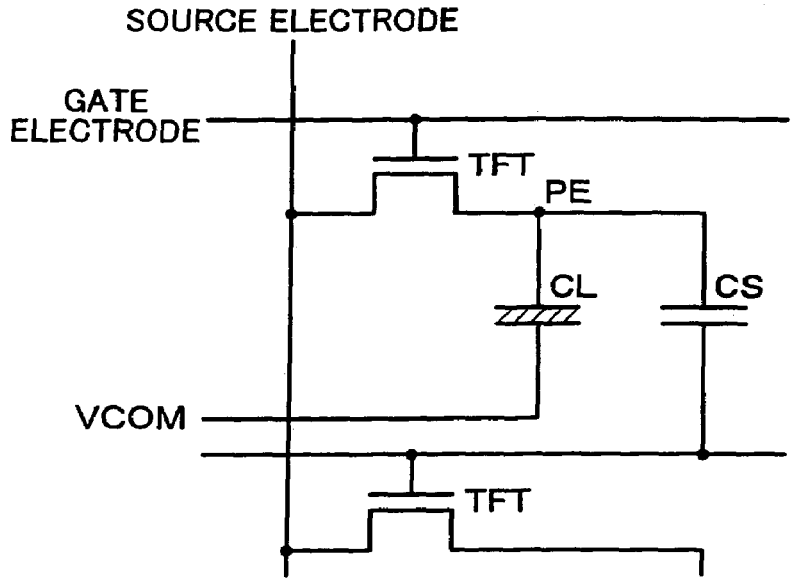
FIG. 10B illustrates an additional capacitance method.

FIG. 10A is a view for describing the storage capacitance method. FIG. 10B is a view for describing the additional capacitance method.

In the storage capacitance method, a storage capacitance CS is formed between the pixel electrode and the common electrode VCOM, as shown in FIG. 10A. This can be achieved by separately providing an interconnect for the common electrode VCOM on an active matrix substrate, for example.

Figure 11:
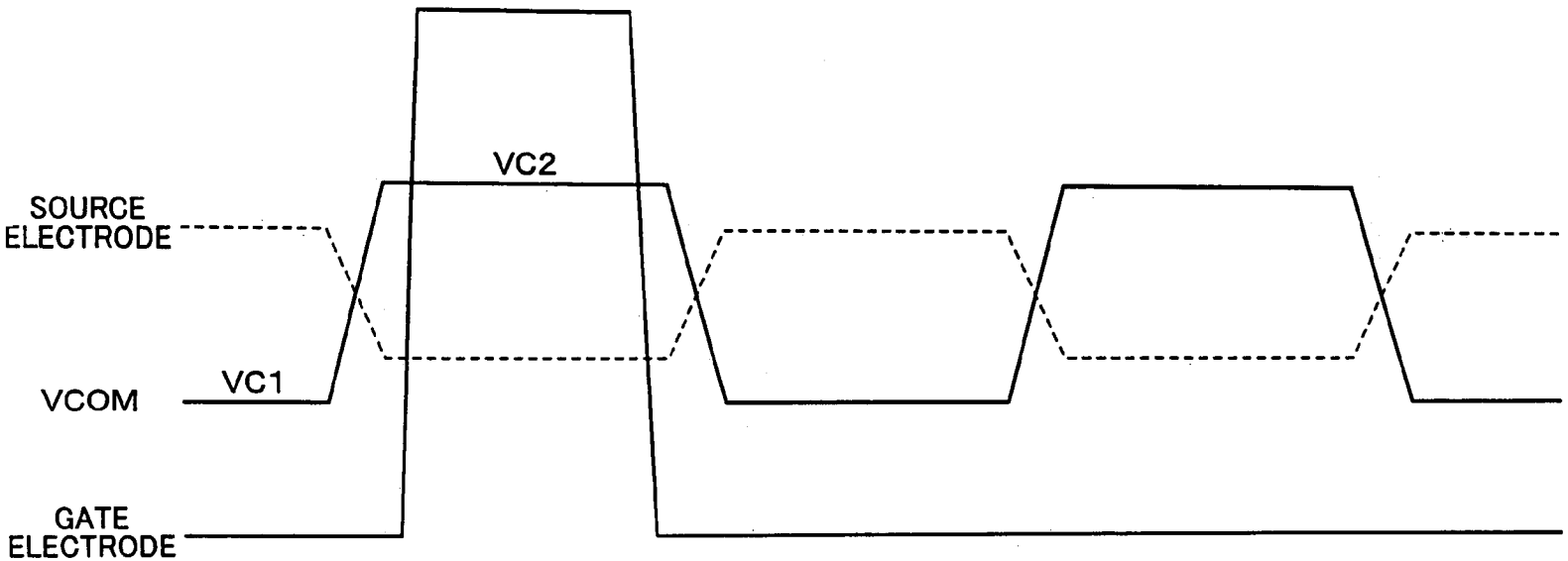
FIG. 11 is a timing waveform chart showing potential changes of a common electrode, a source electrode, and a gate electrode in the storage capacitance method.
Figure 12:
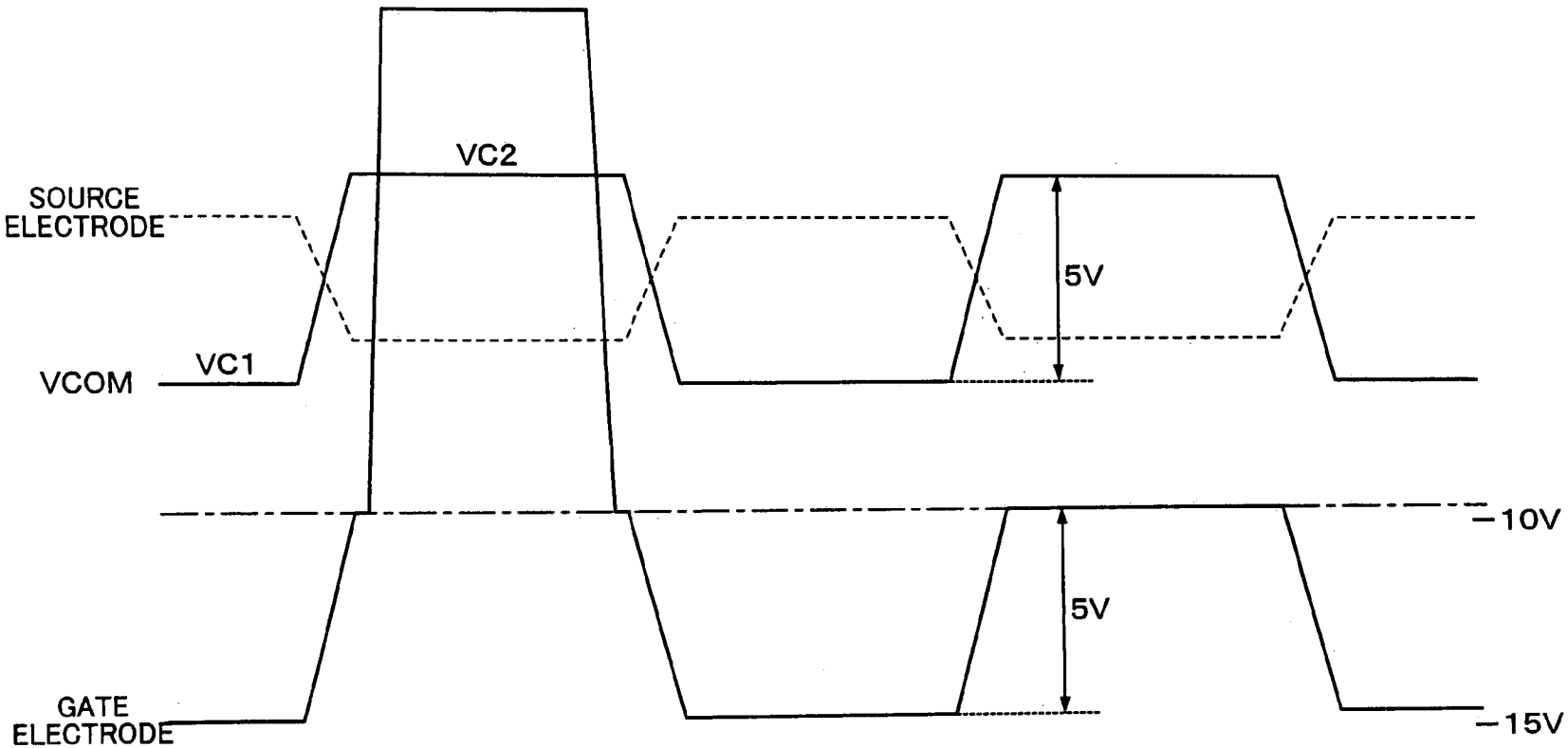
FIG. 12 is a timing waveform chart showing potential changes of the common electrode, the source electrode, and the gate electrode in the additional capacitance method.

Therefore, the polarity of the voltage between the source electrode and the common electrode VCOM is inverted for every scanning period based on a given voltage in the storage capacitance method, as shown in FIG. 11. In the case where the potential of the source electrode is higher than the potential of the common electrode VCOM, a voltage applied to the liquid crystal element is positive. In the case where the potential of the common electrode VCOM is higher than the potential of the source electrode, a voltage applied to the liquid crystal element is negative. A DC voltage can be prevented from being applied to the liquid crystal element for a long period of time by inverting the polarity of the voltage applied to the liquid crystal element for every scanning period, whereby the life of the liquid crystal element can be increased.

In the additional capacitance method, the storage capacitance CS is formed between the pixel electrode and the gate electrode in the preceding stage, as shown in FIG. 10B. This can be achieved by designing the layout so that the pattern of the pixel electrode overlaps the pattern of the gate electrode in the preceding stage.

Therefore, in the additional capacitance method, in the case of inverting the polarity of the voltage applied to the liquid crystal element for every scanning period, the OFF level potential VOFF of the gate electrode must be changed corresponding to the common electrode VCOM for a voltage equal to the voltage between the source electrode and the common electrode VCOM in order to prevent leakage of charges stored in the liquid crystal capacitance.

In the storage capacitance method, the ON level potential is applied to the gate electrode during the selected period, and the constant OFF level potential VOFF is applied to the gate electrode during the non-selected period. In the additional capacitance method, the ON level potential is applied to the gate electrode during the selected period, and the constant OFF level potential VOFF is applied to the gate electrode corresponding to the inversion timing of the common electrode VCOM during the non-selected period.

It is necessary to change the potential to be supplied to the gate electrode (OFF level potential VOFF of the gate electrode, in particular) in this manner depending upon the formation method of the storage capacitance CS. Therefore, the voltage conversion circuit 40 may be designed as described below in order to generate a potential lower than the potential VC1 of the common electrode VCOM (OFF level potential VOFF).

4.1 Storage Capacitance Method

Figure 13:
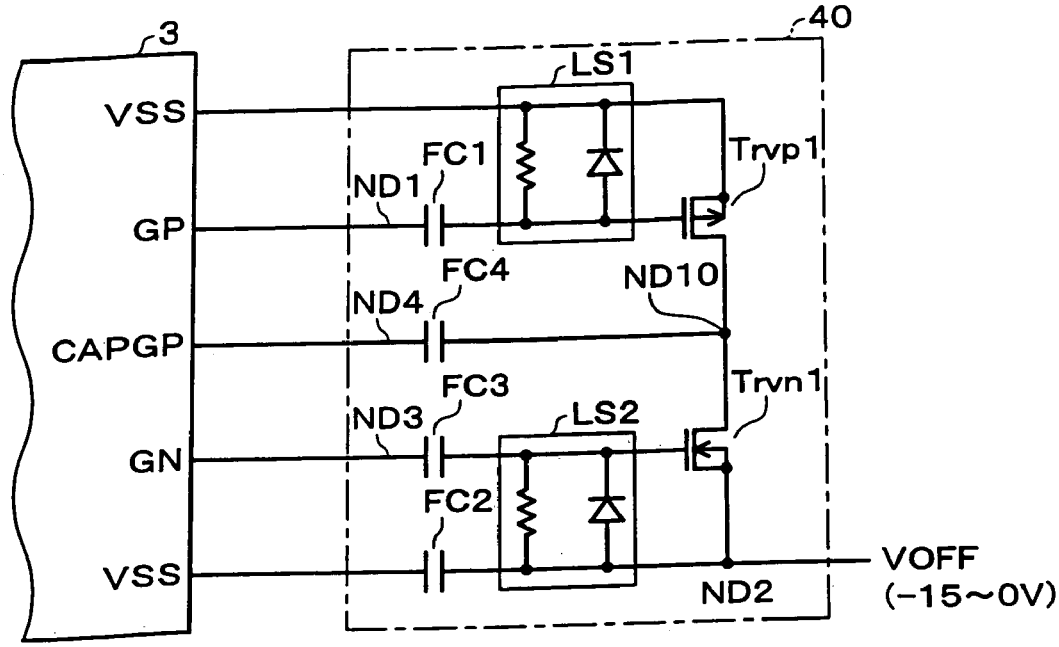
FIG. 13 is a configuration diagram showing an example of the configuration of a voltage conversion circuit in the storage capacitance method.

FIG. 13 is a view showing a configuration example of the voltage conversion circuit 40 in the storage capacitance method.

The voltage conversion circuit 40 generates a negative constant potential (−15 V, for example) based on the grounding power supply potential VSS by using the potential and the booster clock generated by the power supply circuit and the like of the source driver IC (semiconductor device 3).

The voltage conversion circuit 40 includes a p-type MOS transistor Trvp1 of which a source terminal is connected with the grounding power supply potential VSS (first potential), a flying capacitor FC1 (first capacitor) which capacitively couples a node ND1 (first node) and a gate terminal of the p-type MOS transistor Trvp1, and a level shifter LS1 (first level shifter) connected between the source terminal and the gate terminal of the p-type MOS transistor Trvp1. The voltage conversion circuit 40 further includes an n-type MOS transistor Trvn1 of which a drain terminal is connected with a drain terminal of the p-type MOS transistor Trvp1 and a source terminal is connected with a node ND2 (second node), a flying capacitor FC2 (second capacitor) which capacitively couples the grounding power supply potential VSS and the node ND2, a flying capacitor FC3 (third capacitor) which capacitively couples a node ND3 (third node) and a gate terminal of the n-type MOS transistor Trvn1, a level shifter LS2 (second level shifter) connected between the source terminal and the gate terminal of the n-type MOS transistor Trvn1, and a flying capacitor FC4 (fourth capacitor) which capacitively couples a node ND4 (fourth node) to which a booster potential CAPGP is supplied and the drain terminal of the n-type MOS transistor Trvn1.

A first booster clock generated by the power supply circuit of the source driver IC (semiconductor device 3) is supplied to the node ND1.

The node ND2 is at a negative constant potential based on the grounding power supply potential VSS. The node ND2 is connected with the gate driver 6 through a sixth power supply line.

A second booster clock generated by the power supply circuit of the source driver IC (semiconductor device 3) is supplied to the node ND3.

A positive booster potential based on the grounding power supply potential VSS generated by the power supply circuit of the source driver IC (semiconductor device 3) is supplied to the node ND4.

Figure 14:
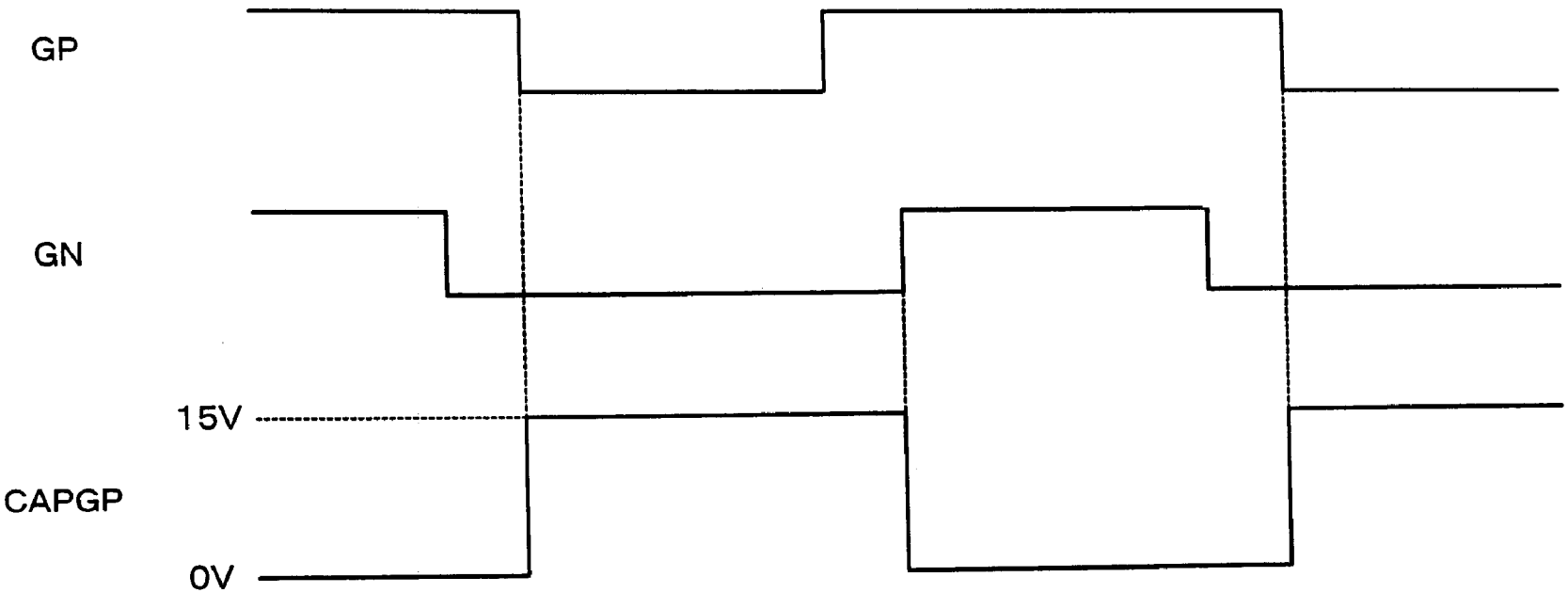
FIG. 14 is a timing waveform chart showing various control signals of the voltage conversion circuit in the storage capacitance method.

The first and second booster clocks GP and GN supplied from the source driver IC are designed so that the first booster clock GP falls after the second booster clock GN has fallen, and the second booster clock GN rises after the first booster clock GP has risen, as shown in FIG. 14. Specifically, the logic level of the second booster clock GN is "L" during a period in which the logic level of the first booster clock GP is "L", and the logic level of the first booster clock GP is "H" during a period in which the logic level of the second booster clock GN is "NH". Specifically, the periods in which the logic levels of the first and second booster clocks GP and GN are "H" have a nonoverlap relation, and the periods in which the logic levels of the first and second booster clocks GP and GN are "L" also have a nonoverlap relation.

The booster potential CAPGP supplied from the source driver IC changes into the positive potential VDDHG (fifth potential) based on the grounding power supply potential VSS at the same timing as ("in synchronization with" in a broad sense) the fall of the first booster clock GP. The booster potential CAPGP changes into the grounding power supply potential VSS at the same timing as ("in synchronization with" in a broad sense) the rise of the second booster clock GN.

The first and second booster clocks GP and GN and the booster potential CAPGP supplied to the voltage conversion circuit 40 are positive potentials based-on the grounding power supply potential VSS. Therefore, a potential difference is provided between the source terminal and the gate terminal of the p-type MOS transistor Trvp1 by using the flying capacitor FC1 and the level shifter circuit LS1. Similarly, a potential difference is provided between the source terminal and the gate terminal of the n-type MOS transistor Trvn1 by using the flying capacitor FC2 and the level shifter circuit LS2.

In the voltage conversion circuit 40, when the p-type MOS transistor Trvp1 is turned ON by the first booster clock GP during a period in which a potential to be boosted such as 15 V is supplied to the booster potential CAPGP, a node ND10 is at the grounding power supply potential VSS. At this time, the n-type MOS transistor Trvn1 is turned OFF by the second booster clock GN.

When the p-type MOS transistor Trvp1 is turned OFF by the first booster clock GP, the n-type MOS transistor Trvn1 is turned ON by the second booster clock GN, and the booster potential CAPGP is at the grounding power supply potential VSS, the potential of the node ND 10 is boosted in the negative direction for the booster potential due to charges stored in the flying capacitor FC4. As a result, the potential of the node ND2 is at the booster potential CAPGP which is boosted in the negative direction (−15 V when CAPGP is 15 V, for example).

4.2 Additional Capacitance Method

Figure 15:
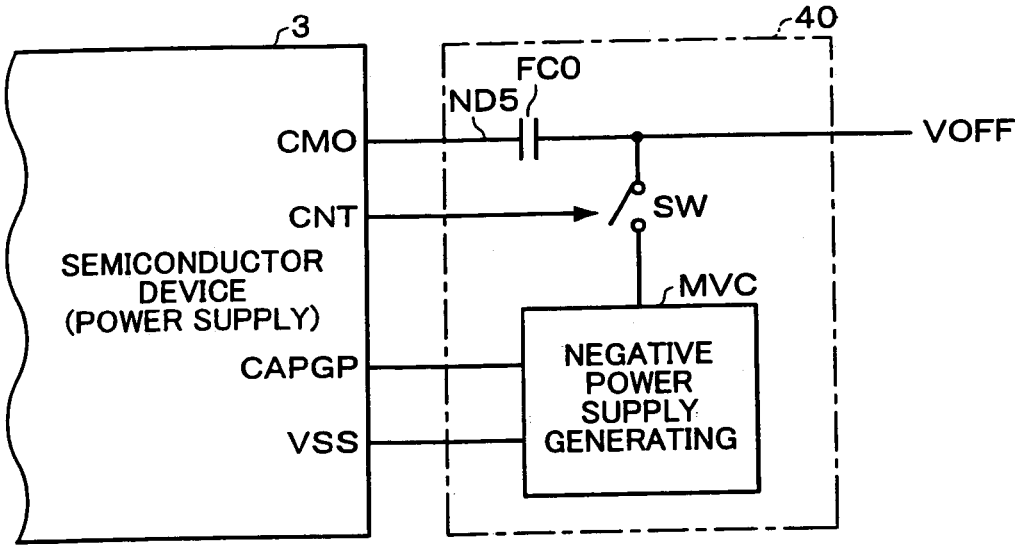
FIG. 15 is a configuration diagram showing an outline of the principle of the configuration of the voltage conversion circuit in the additional capacitance method.

FIG. 15 is a view showing an outline of the principle of the configuration of the voltage conversion circuit in the additional capacitance method.

The voltage conversion circuit 40 includes a flying capacitor FC0 (fifth capacitor) which capacitively couples the sixth power supply line to which a negative constant potential (−15 V, for example) based on the grounding power supply potential VSS is supplied and a node ND5 (fifth node) to which the CMO signal (polarity inversion timing signal of the common electrode VCOM) is supplied, a negative power supply generating circuit MVC which generates a sixth potential of negative polarity based on the booster potential CAPGP which is the potential difference between the potential VDDHG (fifth potential) and the grounding power supply potential VSS, and a switching element SW connected between the negative power supply generating circuit MVC and the sixth power supply line.

In the voltage conversion circuit 40, the negative power supply generating circuit MVC generates the sixth potential of negative polarity which is a constant potential based on the booster potential CAPGP which is the potential difference between the potential VDDHG (fifth potential) and the grounding power supply potential VSS.

The CMO signal and a switching control signal CNT which controls the switching element SW change while maintaining a constant relation in time with each other ("in synchronization with each other" in a broad sense). However, it is preferable that the change timing of the CMO signal does not coincide with the change timing of the switching control signal CNT. The sixth power supply line is at the sixth potential when the switching element SW is turned ON by the switching control signal CNT. At this time, the CMO signal is at the grounding power supply potential VSS.

When the switching element SW is turned OFF and the CMO signal is at a given potential, the sixth power supply line is at a potential increased for the given potential. For example, when the CMO signal changes at an amplitude of 5 V, the sixth potential changes between −15 V and −10 V at almost the same timing as ("in synchronization with" in a broad sense) the CMO signal.

In FIG. 15, the switching control signal CNT is supplied from the semiconductor device 3. However, the booster clock supplied from the semiconductor device 3 to the negative power supply generating circuit MVC may be shared as the switching control signal CNT.

Figure 16:
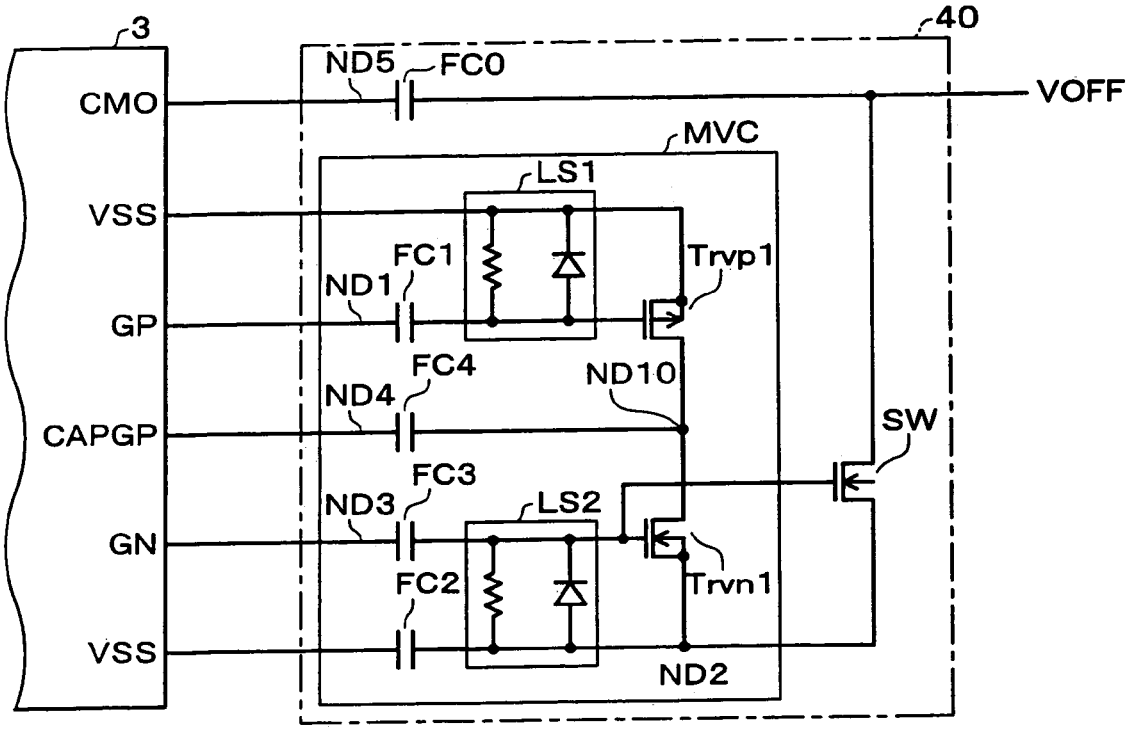
FIG. 16 is a configuration diagram showing an example of the configuration of the voltage conversion circuit in the additional capacitance method.

FIG. 16 is a view showing a detailed configuration example of the voltage conversion circuit 40 in the additional capacitance method.

In FIG. 16, sections the same as those of the voltage conversion circuit in the storage capacitance method shown in FIG. 13 are indicated by the same symbols. Description of these sections is appropriately omitted. In FIG. 16, sections the same as those of the voltage conversion circuit shown in FIG. 15 are indicated by the same symbols. Description of these sections is appropriately omitted.

The voltage conversion circuit in the additional capacitance method shown in FIG. 16 differs from the voltage conversion circuit in the storage capacitance method shown in FIG. 13 in that a flying capacitor FC0 which capacitively couples the node ND5 to which the CMO signal is supplied and the sixth power supply line, and a switching element SW (n-type switching transistor) connected between, the sixth power supply line and the node ND2 are provided. A gate terminal of the switching element SW and the gate terminal of the n-type MOS transistor Trvn1 are electrically connected so that the gate terminals of the switching element SW and the n-type MOS transistor Trvn1 are at the same potential. The second booster clock GN is shared by the gate terminals of the switching element SW and the n-type MOS transistor Trvn1 in order to control the gate of the switching element SW.

Figure 17:
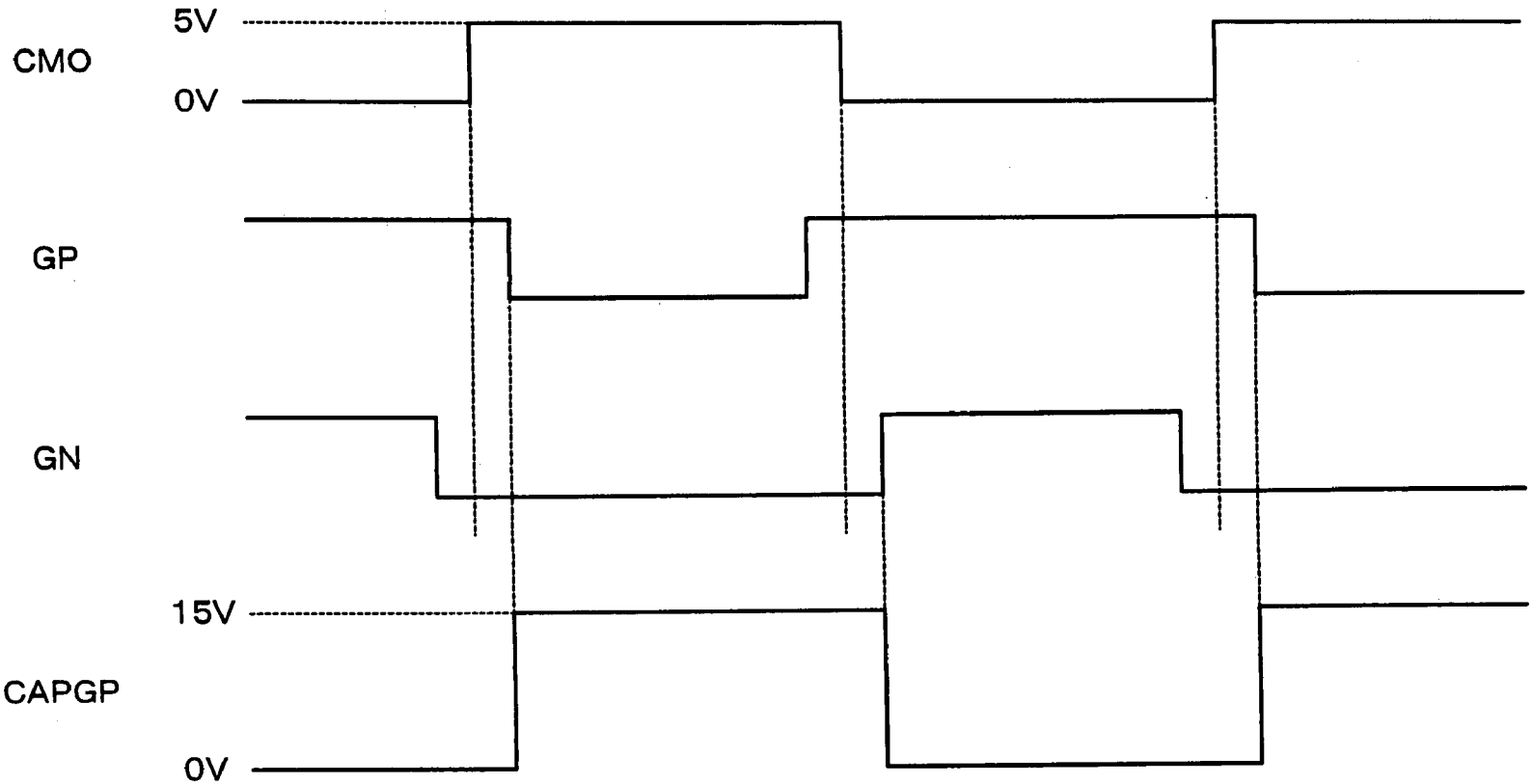
FIG. 17 is a timing waveform chart showing various control signals of the voltage conversion circuit in the additional capacitance method.

In this voltage conversion circuit 40, the CMO signal, the first and second booster clocks GP and GN, and the booster potential CAPGP change as shown in FIG. 17. Only the CMO signal differs from the control timing in the storage capacitance method shown in FIG. 14. Specifically, the CMO signal changes while maintaining a constant relation in time with ("in synchronization with" in a broad sense) the second booster clock GN. However, it is preferable that the change timing of the CMO signal does not coincide with the change timing of the second booster clock GN. It is preferable that the change timing of the CMO signal exists between the change timing of the second booster clock GN and the change timing of the first booster clock GP, as shown in FIG. 17.

In the voltage conversion circuit 40, the node ND2 is at the sixth potential of negative polarity which is a constant potential in the same manner as in FIG. 13. Therefore, when the logic level of the second booster clock GN is "H", the n-type MOS transistor Tnvn1 and the switching element SW are turned ON, whereby the sixth power supply line is at the sixth potential.

Since the CMO signal is at the grounding power supply potential VSS, the opposite ends of the flying capacitor FC0 are at 0 V and −15 V. The potential of the sixth power supply line may change between a potential which is increased for the amplitude of the CMO signal and the grounding power supply potential VSS by changing the CMO signal by allowing the switching element SW to be turned OFF. Specifically, if the CMO signal is at 5 V, the sixth potential changes between −15 V and −10 V almost at the same timing as ("in synchronization with" in a broad sense) the amplitude operation of the CMO signal between 0 V and 5 V.

As described above, a voltage conversion circuit which generates a negative power supply with a very simple configuration can be provided in both the storage capacitance method and the additional capacitance method. In particular, since the power supply circuit is included in the semiconductor device 3, a negative power supply can be generated with a very simple configuration by allowing the booster clock generated by the power supply circuit to be output to the outside. Therefore, a negative power supply can be generated by using a simple circuit even in the case of using a low voltage power supply circuit, whereby a necessary potential can be supplied to a high voltage gate driver.

5. Electronic Equipment

The case where a display device having the source driver IC (semiconductor device 3) including the above-described power supply circuit is applied to electronic equipment is described below.

Figure 18:
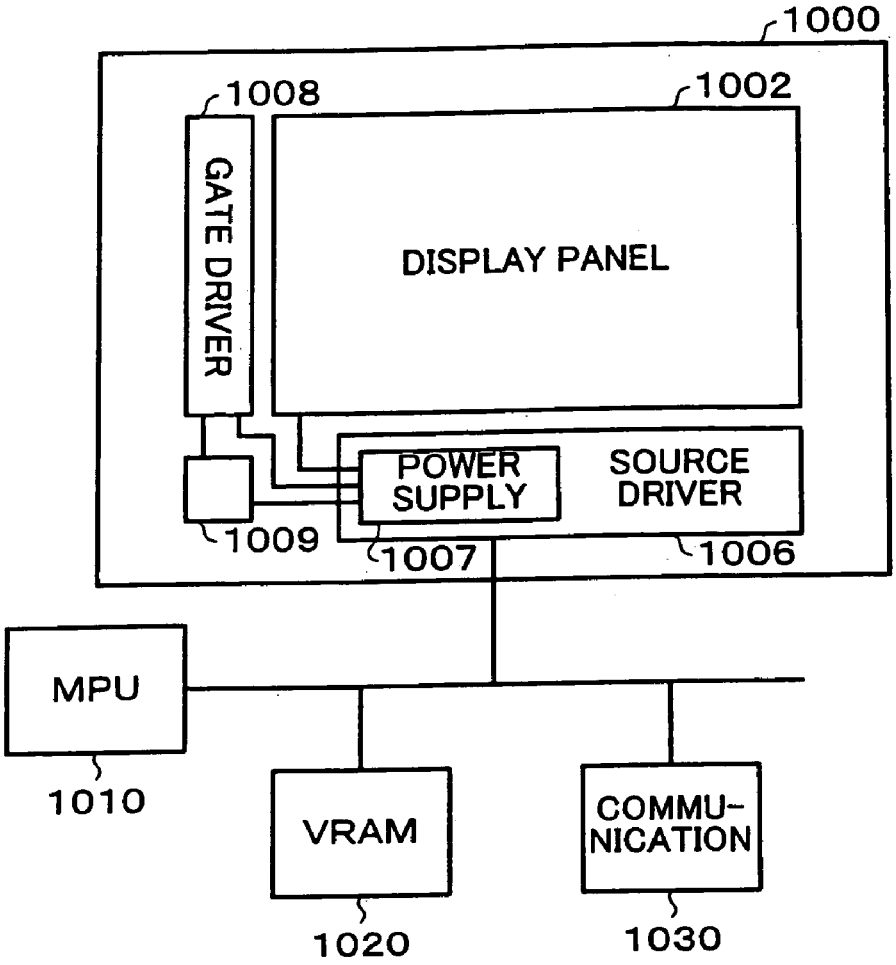
FIG. 18 is a block diagram showing an example of electronic equipment to which the display device of the present embodiment is applied.

FIG. 18 shows an example of a block diagram of electronic equipment of the present embodiment.

A display device 1000 of the present embodiment is connected with an MPU 1010 through a bus. A VRAM 1020 and a communication section 1030 are also connected with the bus.

The MPU 1010 controls each section through the bus.

The VRAM 1020 has a storage region corresponding to each pixel of a display panel 1002 of the display device 1000, for example. Image data randomly written by the MPU 1010 is sequentially read along the scan direction.

The communication section 1030 performs various types of control for communicating with the outside (host device and other electronic equipment, for example). The function of the communication section 1030 can be achieved by various types of processors, hardware such as a communication ASIC, a program, and the like.

In this electronic equipment, the MPU 1010 sets commands for generating potentials necessary for the display panel 1002, a driver section of a source driver 1006, and a gate driver 1008 to a power supply circuit 1007 included in a source driver IC 1006. The MPU 1010 generates various timing signals necessary for driving the display panel 1002 of the display device 1000.

A voltage conversion circuit 1009 generates a negative potential based on the grounding power supply potential VSS based on a potential supplied from the power supply circuit 1007, and supplies the negative potential to the gate driver 1008.

This enables the cost and power consumption of the source driver IC 1006 to be decreased and the configuration of the voltage conversion circuit 1009 to be simplified. As a result, the cost and power consumption of the display device 1000 and the electronic equipment to which the display device 1000 is applied can be decreased.

Figure 19:
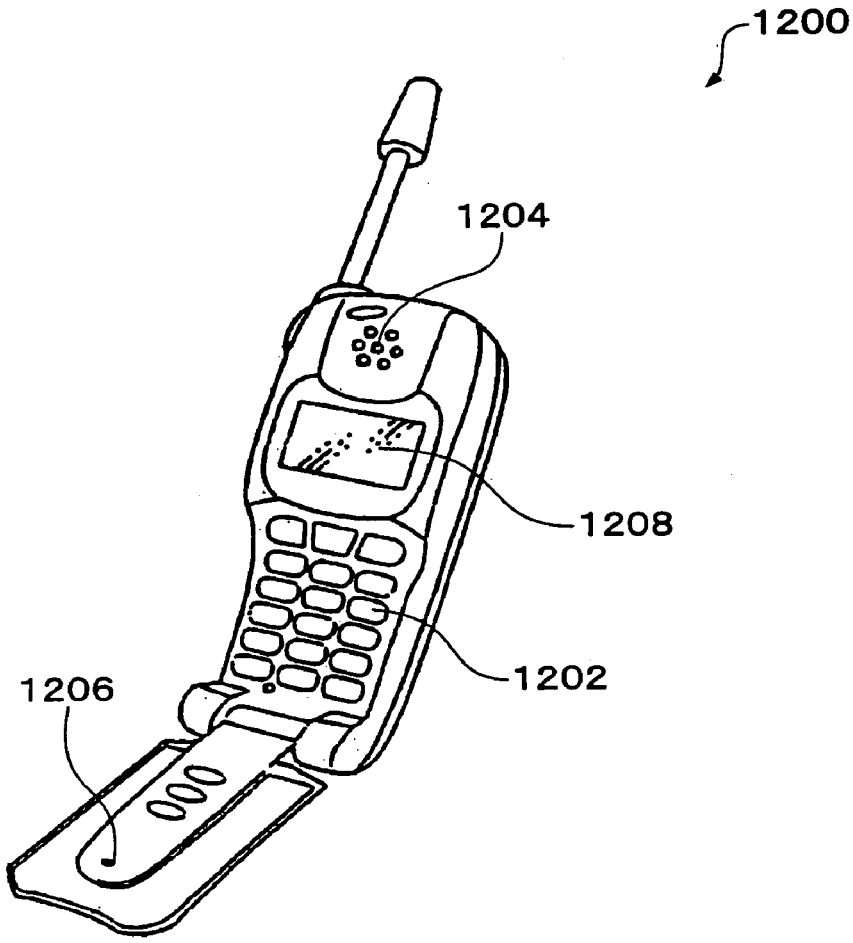
FIG. 19 is a perspective view showing a portable telephone to which the display device of the present embodiment is applied.

FIG. 19 is a perspective view showing a portable telephone to which the display device of the present embodiment is applied.

A portable telephone 1200 includes a plurality of operation buttons 1202, a receiver 1204, a microphone 1206, and a panel 1208. As the panel 1208, a panel which makes up the display device of the present embodiment is applied. The panel 1208 displays a field intensity, numbers, characters while waiting. The entire area of the panel 1208 is used as the display area during receiving or sending. In this case, power consumption can be decreased by controlling the display area.

The present invention is not limited to the above embodiment. Various modifications and variations are possible.

As the electronic equipment to which the display device of the present embodiment is applied, equipment for which a decrease in power consumption is strongly demanded such as a pager, watch, and a personal data assistant (PDA) is suitable in addition to the above-described portable telephone. In addition, the display device of the present embodiment can also be applied to a liquid crystal TV, view finder type or direct-view monitor type video tape recorder, car navigation system, calculator, word processor, work station, videophone, POS terminal, equipment provided with a touch panel, and the like.

The present embodiment is described taking the case of applying the present invention to the display panel main body using a TFT as an example. However, the present invention is not limited thereto. The present invention can also be applied to an electroluminescence (EL) device, an organic EL device, and a plasma display device.

The display device 2 of the present embodiment can be formed by bonding a flexible printed circuit (FPC) substrate to the display panel main body 4, and mounting at least one of the semiconductor device 3, the gate driver 6, and the voltage conversion circuit 40 on the FPC substrate. However, at least one of the semiconductor device 3, the gate driver 6, and the voltage conversion circuit 40 may be directly mounted on the panel of the display panel body 4.

The invention according to the dependent claim may have a configuration in which some of the constituent elements of the claim on which the invention is dependent are omitted. It is possible to allow the feature of the invention according to the independent claim to depend on other independent claim.

What is claimed is:

1. A voltage conversion circuit which generates an output potential that is negative based on a first potential, comprising:

a capacitor which capacitively couples a node to which a timing signal changing between given potentials is supplied and an output power supply line to which the output potential is supplied;

a negative power supply generating circuit which generates a negative potential based on the first potential based on a difference between the first potential and an input potential which is positive based on the first potential; and a switching element which is inserted between a node to which the negative power supply potential is supplied and the output power supply line, and controlled based on a given switching control signal, wherein the timing signal and the switching control signal change in synchronization with each other.

2. The voltage conversion circuit as defined in claim 1, wherein the switching element is an n-type switching transistor, wherein the negative power supply generating circuit comprises:

a p-type transistor, a source terminal of which is connected with the first potential;

a first capacitor which capacitively couples a first node to which a first booster clock is supplied and a gate terminal of the p-type transistor;

a first level shifter which is connected between the source terminal of the p-type transistor and the gate terminal of the p-type transistor;

an n-type transistor, a drain terminal of which is connected with a drain terminal of the p-type transistor, and a source terminal of which is connected with a second node;

a second capacitor which capacitively couples the first potential and the second node;

a third capacitor which capacitively couples a third node to which a second booster clock is supplied and a gate terminal of the n-type transistor;

a second level shifter which is connected between the source terminal of the n-type transistor and the gate terminal of the n-type transistor; and a fourth capacitor which capacitively couples a fourth node to which a given potential is supplied and the drain terminal of the n-type transistor, wherein the first booster clock falls after the second booster clock has fallen, and the second booster clock rises after the first booster clock has risen, wherein the potential supplied to the fourth node changes to the input potential in synchronization with fall of the first booster clock, and changes to the first potential in synchronization with rise of the second booster clock, and wherein the source terminal of the n-type transistor is connected with the output power supply line through the n-type switching transistor.

3. A display device comprising:

a power supply circuit which includes: a first booster circuit which is connected with first and second power supply lines, which respectively supply first and second potentials, and supplies a third potential which is boosted based on a difference between the first and second potentials to a third power supply line; a potential regulator circuit which is connected with the first and third power supply lines and supplies a fourth potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line;

a display which includes a plurality of source electrodes and a plurality of gate electrodes;

the voltage conversion circuit as defined in claim 1 with which the first power supply line, to which the first potential is supplied, and the fifth power supply line, to which the fifth potential is supplied as the input potential, are connected;

a source electrode driver circuit with which at least the fourth power supply line is connected and which drives the plurality of source electrodes; and a gate electrode driver circuit with which at least the fifth power supply line and the output power supply line, to which the output potential generated by the voltage conversion circuit is supplied, are connected.

4. Electronic equipment comprising the voltage conversion circuit as defined in claim 1.

5. Electronic equipment comprising:

a power supply circuit which includes: a first booster circuit which is connected with first and second power supply lines, which respectively supply first and second potentials, and supplies a third potential which is boosted based on a difference between the first and second potentials to a third power supply line; a potential regulator circuit which is connected with the first and third power supply lines and supplies a fourth potential, which is a constant potential generated based on a difference between the first and third potentials, to a fourth power supply line; and a second booster circuit which is connected with the first and fourth power supply lines and supplies a fifth potential, which is boosted based on a difference between the first and fourth potentials, to a fifth power supply line; and the voltage conversion circuit as defined in claim 1 with which the first and fifth power supply lines are connected, wherein the fifth potential supplied to the fifth power supply line is used as an input potential to the voltage conversion circuit.

6. Electronic equipment comprising the display device as defined in claim 3.

* * * * *